US005226404A

United States Patent [19]

Mogi et al.

[11] Patent Number: 5,226,404

[45] Date of Patent: Jul. 13, 1993

[54] CUTTING APPARATUS

[75] Inventors: Katsumi Mogi; Hiro Ohzeki, both of Omiya, Japan

[73] Assignee: Mitsubishi Metal Corporation, Tokyo, Japan

[21] Appl. No.: 902,477

[22] Filed: Jun. 19, 1992

Related U.S. Application Data

[63] Continuation of Ser. No. 586,958, Sep. 24, 1990, abandoned.

[30] Foreign Application Priority Data

| | | | |
|---|---|---|---|
| Sep. 22, 1989 | [JP] | Japan | 1-247674 |
| Oct. 24, 1989 | [JP] | Japan | 1-276893 |
| Nov. 17, 1989 | [JP] | Japan | 1-298835 |
| Dec. 12, 1989 | [JP] | Japan | 1-322237 |
| May 11, 1990 | [JP] | Japan | 2-122562 |

[51] Int. Cl.[5] ..... B28D 1/08

[52] U.S. Cl. ..... 125/21; 83/794; 83/810; 83/831

[58] Field of Search ..... 83/788, 801, 808, 810, 83/794, 830, 831, 832, 833, 834, 820; 125/21

[56] References Cited

U.S. PATENT DOCUMENTS

| | | | |
|---|---|---|---|
| 614,003 | 11/1898 | Johnson . | |
| 1,178,362 | 4/1916 | Wall . | |
| 1,363,171 | 12/1920 | Sly . | |
| 1,392,503 | 10/1921 | Jackson | 125/21 |
| 1,598,953 | 9/1926 | Daw . | |
| 1,619,128 | 3/1927 | Jobst | 125/21 |
| 1,671,295 | 5/1928 | Kirby . | |
| 1,779,983 | 10/1930 | Bens . | |
| 2,481,835 | 9/1949 | Gannon . | |
| 2,488,343 | 11/1949 | Standal . | |
| 2,654,404 | 10/1953 | Neuhauser et al. | 83/808 |
| 2,702,538 | 2/1955 | Burkhardt | 125/21 |
| 2,869,534 | 1/1959 | Stihl . | |
| 3,228,437 | 1/1966 | Wezel . | |
| 3,910,147 | 10/1975 | Hayerdahl | 83/830 |
| 4,067,312 | 1/1978 | Tessner | 125/21 |
| 4,309,931 | 1/1982 | Alexander | 83/832 |
| 4,464,964 | 8/1984 | Alexander | 83/830 |
| 4,562,761 | 1/1986 | Alexander | 83/830 |
| 4,787,363 | 11/1988 | Kubo | 125/21 |
| 4,896,648 | 1/1990 | Boller | 125/21 |
| 4,971,022 | 11/1990 | Scott et al. | 125/21 |
| 4,986,252 | 1/1991 | Holmes et al. | 125/21 |

FOREIGN PATENT DOCUMENTS

| | | |
|---|---|---|
| 505203 | 12/1952 | Belgium . |
| 518164 | 2/1955 | Belgium . |
| 3416712 | 11/1985 | Fed. Rep. of Germany . |
| 595055 | 9/1925 | France . |

*Primary Examiner*—Frank T. Yost
*Assistant Examiner*—Rinaldi Rada
*Attorney, Agent, or Firm*—Scully, Scott, Murphy & Presser

[57] ABSTRACT

A cutting apparatus comprises an endless chain body comprising a plurality of plate-like flaps connected to each other for angular movement in a common plane. Each flap has an end face on an inner peripheral side of the chain body, and at least a part of the flaps having a cutting device at the end face. The apparatus further comprises a plurality of sprockets supporting the chain body in tension, and defining a common plane of cut effected by the combination of the chain body and the sprockets. The chain body is supported by a rigid backplate, of thickness not greater than the thickness of the flaps. It provides a firm support to the rotating chain body to permit sliding movement of the chain body within the common plane of cut. The apparatus further comprises a means for activating the rotational movement of the sprockets in cooperation with the chain body, and a means for moving an object or the chain body toward each other to effect removal of a material disposed within the extended plane of the common plane of cut to effect separation of an object into severed sections.

21 Claims, 32 Drawing Sheets

CUTTING APPARATUS

This is a continuation of copending application Ser. No. 586,958 filed on Sep. 24, 1990, now abandoned.

BACKGROUND OF THE INVENTION

1. Field of the Invention

The present invention relates to a cutting apparatus for cutting large objects of different materials, such as stone, wood and other substances.

2. Background Art

Conventionally, cutting a large stone, for example, is carried out with a cutting blade, a band saw, a wire saw and other cutting methods.

Cutting blade is a device containing a plurality of cutting bits in which chips of abrasive grains, such as fine diamond abrasive grains are firmly embedded. The abrasive layers are bonded to an outer peripheral surface of a disc-like metal base formed by roll processing, by means of metal bond or the like at equal intervals. At present, the maximum cutting blade manufactured has a diameter of 3.5 m and a metal base thickness of 10 mm. For the cutting blade of this dimension or size, the maximum thickness of a material which can be cut is of the order of 1.5 m, and the cutting loss is of the order of 15 mm.

On the other hand, a band saw is a device having a thin strip of metal, which is wide and which is of the order of 1 mm to 6 mm in thickness, is welded to form an endless loop, and the abrasive grains and chips are firmly bonded to one side of the endless thin strip. The endless thin strip driven by a pair of rotating circular wheels, whose axes are arranged in parallel relation to each other. The wheels are rotated at high speed, thereby cutting stones or the like with the edge of any parallel sections between the rotor bodies.

The wire saw is an endless loop device such that a plurality of cylindrical diamond chips is firmly bonded to a metal wire whose thickness is of the order of a few millimeters to 10 mm. The wire saw is directly wound around the object, and is driven at high speeds with a constant tension applied by a drive apparatus, thereby cutting the object.

However, the above-described traditional cutting methods have the following problems.

First, the cutting blade has the following problem. That is, if the diameter of the cutting blade is increased, the thickness of the metal base must also be increased to provide the blade rigidity. For this reason, the cutting loss increases, and the yield from the object is diminished. Further, twist or torsion occurs at the forward edge of cutting as a result of an increase in the cutting resistance. Thus, the cutting accuracy is reduced.

Further, the cutting blade has also the following problems. Since manufacturing of a metal base exceeding 3.5 meter in diameter is extremely difficult, there is a limit in thickness of the object capable of being cut, as described previously. Moreover, such large cutting blade is extremely inconvenient for handling and transporting or the like; also the noises due to vibration at cutting are severe.

On the other hand, in the band saw, the metal base is thin and long in length, and the cutting loss is of the order of 4 mm to 8 mm which is relatively small. Thus, the yield is superior. However, the band saw is wound around a pair of large-diameter rotating wheels, and accordingly, the cutting apparatus increases in size, and a large equipment space is required.

Furthermore, the band saw has the following problem. That is, bending stress is repeatedly applied to bent sections of the metal base wrapped around the rotating wheels and metal fatigue is apt to be accumulated in the metal base. Thus, the metal base is broken relatively prematurely, and the service life of the metal base is short.

In the wire saw, since the chips in the abrasive-grain-layer are large in diameter, the cutting allowance must be large in comparison with the size of the cutting blade or the band saw. Further, the wire saw is circular in cross-section, and has, by itself, no means for restricting the cutting direction. Accordingly, the wire saw is inferior to other cutting methods in flatness and surface roughness of the cut surface. Furthermore, in the wire saw, since large bending stress is applied to both end portions of each of the abrasive-grain-layers during cutting, the service life is short. Breakage of the wire is dangerous because the ends of the wire jumps up and down like a whip.

SUMMARY OF THE INVENTION

An object of the invention is therefore to provide a cutting apparatus having improved performance characteristics with respect to the above discussed problems. This invention relates to a cutting apparatus comprising;

(a) an endless chain body comprising a plurality of plate-like flaps connected to each other for angular movement in a common plane, said each flap having an end face on an inner peripheral side of said chain body, and at least a part of said flaps having a cutting device at said end face;

(b) a plurality of sprockets supporting said chain body in tension, and defining a common plane of cut effected by the combination of the chain body and the sprockets;

(c) a rigid backplate, of thickness not greater than the thickness of the flaps, providing a firm support to said rotating chain body to permit sliding movement of said chain body within said common plane of cut;

(d) a means for activating the rotational movement of the sprockets in cooperation with the chain body; and (e) a means for moving an object or said chain body toward each other to effect removal of a material disposed within the extended plane of said common plane of cut to effect separation of an object into severed sections.

This cutting apparatus provides cutting action by rotating the chain body equipped with cutting devices around at least a pair of sprockets to drive the chain body which is supported at the linear section of the chain body by means of a chain guide disposed on a rigid backplate. The cutting is carried out by moving either the chain cutter and sprockets towards the object or the object to the chain body.

Because the thickness of the flap and the backplate is thinner than that of the cutting devices, the depth of cut is not limited by the thickness of the cutting device of the equipment.

According to the chain cutter, since the flaps, each in the shape of a plain plate, are connected to each other for angular movement in the cutting plane to form the endless chain body, it is possible to obtain sufficient tension-resisting force by using the flaps of relatively thin thickness. The thickness of each of the cutting devices can be reduced, thus, the cutting cost of the object can be reduced leading to improved yield.

Further, since the flaps are flexibly connected to each other, stress fatigue does not occur in the curved region of the chain cutter, and it is possible to use the chain cutter with a higher applied tension force than in conventional cutting devices. Accordingly, the cutting service life is longer than in the conventional cutting tools, and it is possible to enhance cutting efficiency.

Furthermore, since the chain cutter is supported at the inner straight section of the chain by a support section of the rigid backplate, it is possible to support a high load required for large cutting bite.

Moreover, by merely changing the number of connected flaps, the length of the chain body can be freely increased or decreased. Thus, the object capable of being cut is not restricted in size or dimension. The individual flaps are small in size and the same in configuration as each other. Accordingly, the flaps can be mass produced thereby reducing the cost of the entire chain cutter.

Further, since the advancing direction of the cutting is restricted by the plate-shaped flaps, the flatness and surface roughness of the cut surface are superior, and no one-sided wear occurs on the cutting devices. Thus, the service efficiency of the cutting devices is high.

Furthermore, since the flaps are moving in the same plane as the cutting plane while being wound around the sprockets or the like, there is an advantage that the working space for the apparatus can be reduced.

Moreover, since the chain cutter is in the shape of a chain, and is relatively light in weight, handling and transportation or the like are easy. Vibration due to cutting is attenuated at the connecting sections between the flaps. Thus, it is possible to reduce the noises as compared with other cutting tools.

BRIEF DESCRIPTION OF THE DRAWINGS

FIG. 4 is a view taken along a line IV—IV in FIG. 3.

FIGS. 5 to 7 are a front view, plan view and a left side view, respectively, of a flap.

DETAILED DESCRIPTION OF THE PREFERRED EMBODIMENTS

Various embodiments of the invention will be described next with reference to the drawings.

Figure 1:
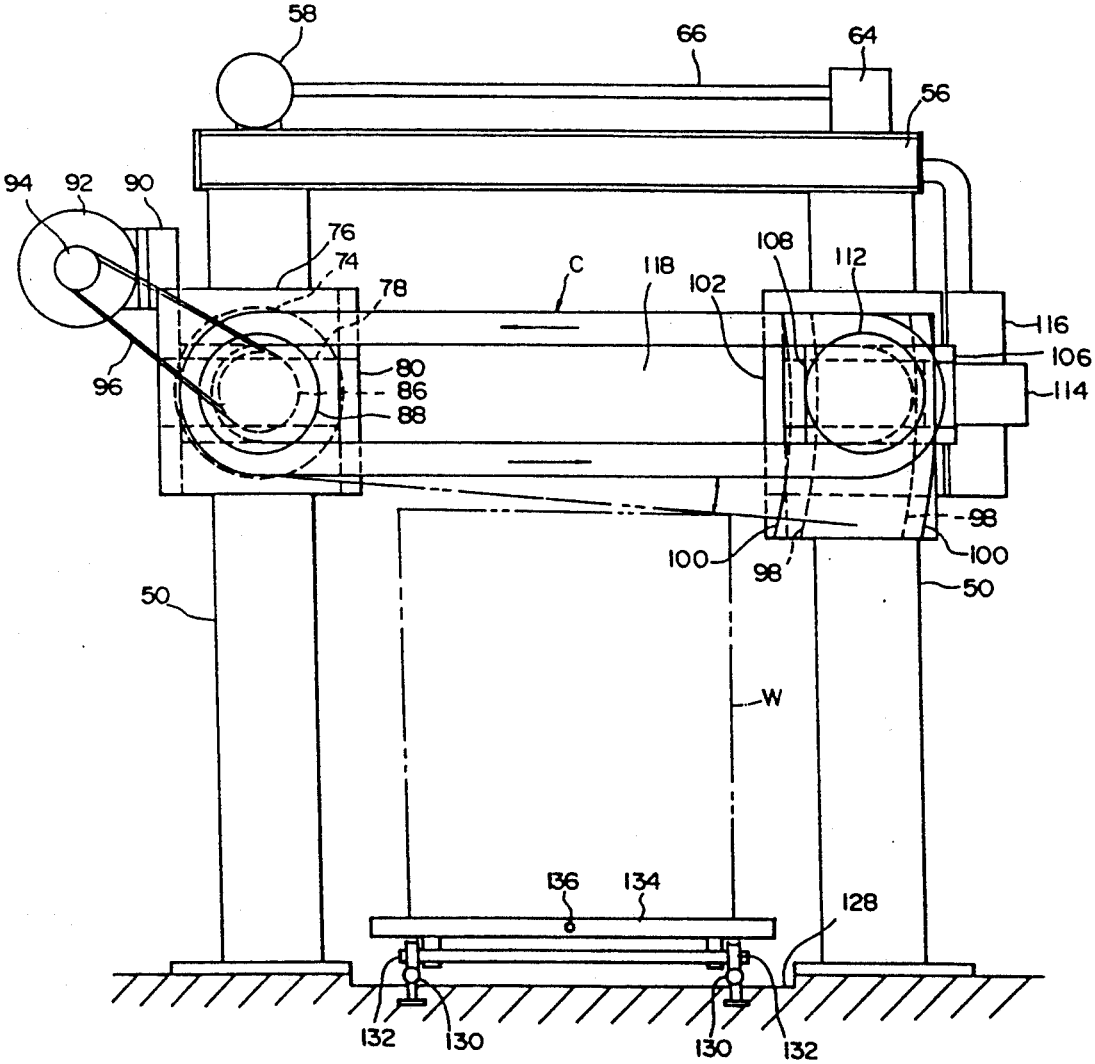
FIGS. 1 is a front view of the cutting apparatus.
Figure 2:
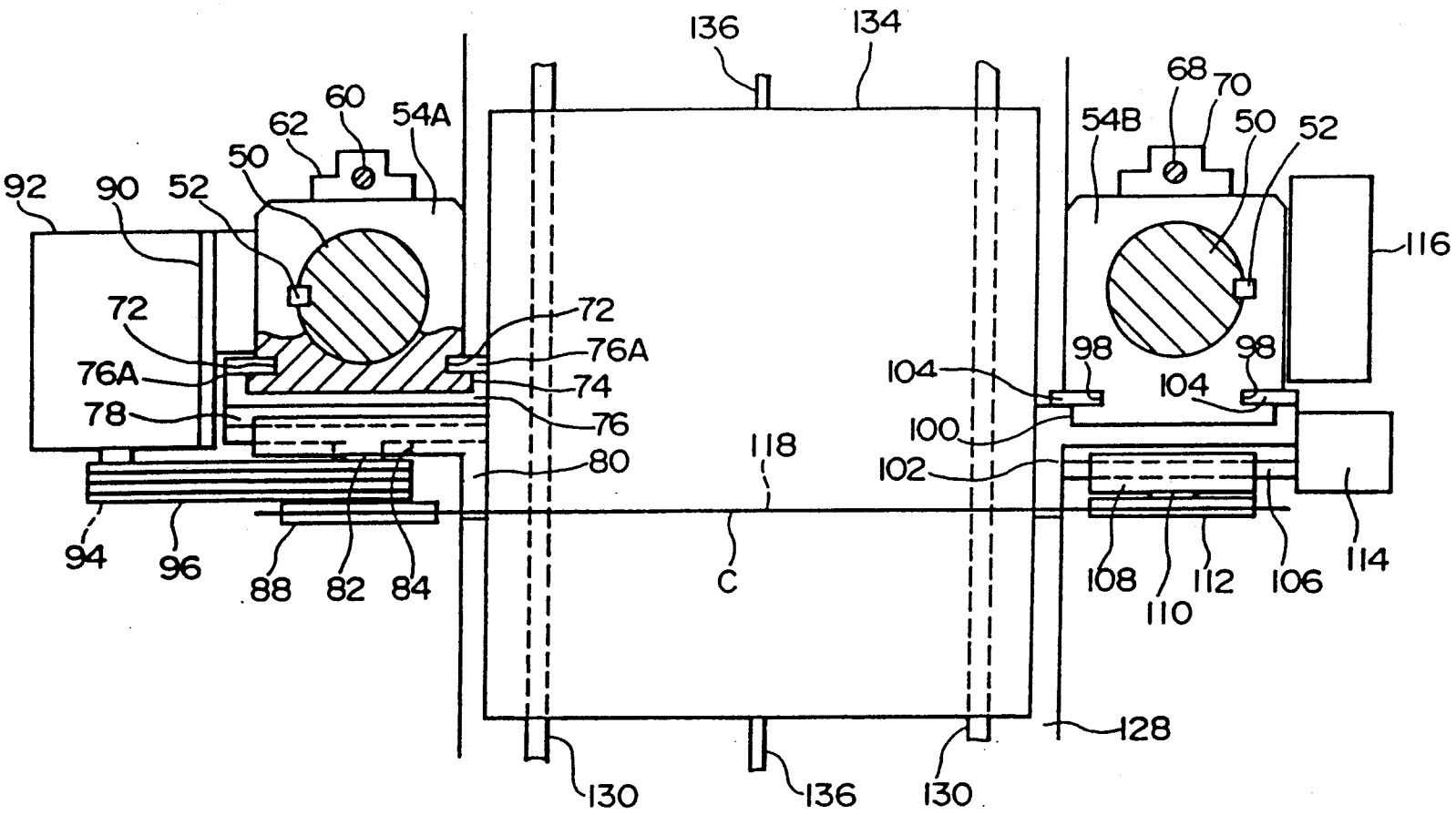
FIG. 2 is a plan view of the cutting apparatus with a partial horizontal cut-away.

FIG. 1 is a front view and FIG. 2 is a plan view with a partial cut-away of the column section of a cutting apparatus according to a first embodiment of the invention.

In these figures, C represents a chain of cutters (hereinafter referred to as the chain cutter) and is a primary component of the cutting apparatus. The details of this component will be explained in the following.

Figure 3:
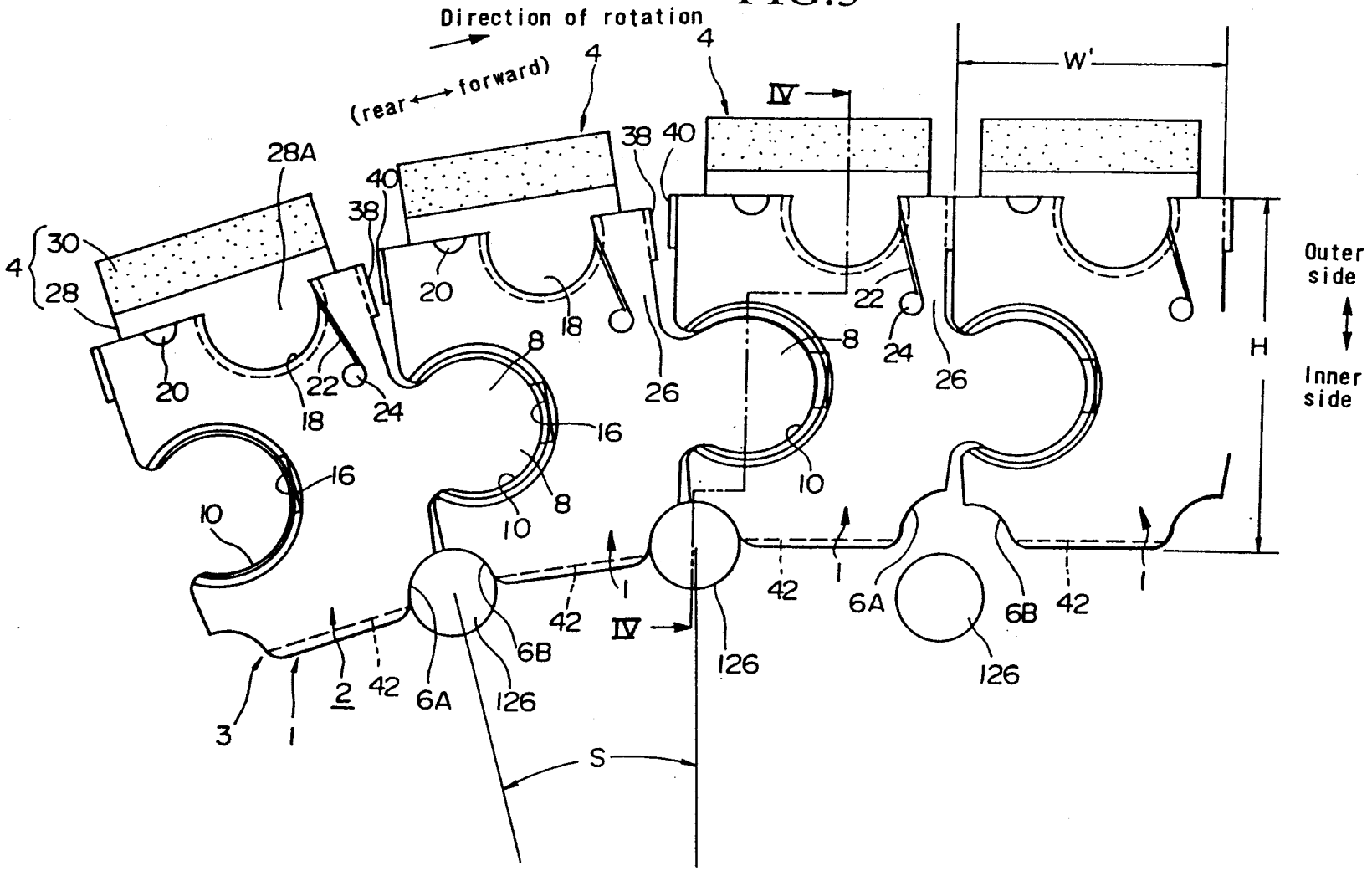
FIGS. 3 through 5 are sectional front views of the chain cutter flaps illustrated in FIGS. 1 and 2.

The chain cutter C is comprising an endless chain body 2 in which a plurality of flaps 1, each in the shape of a plain or flat plate, is connected to each other, as shown in FIG. 3, to provide a flexible angular movement within a cutting plane (hereinafter the cutting plane is defined by the path of the chain cutter). A plurality of abrasive-grain segments or cutting device 4 is firmly mounted to the outer ends of the respective flaps 1.

Each flap 1 is in the shape of a rectangular plate having a constant thickness, and is made of metal such as SK steel, stainless steel, SKD steel, SUP steel, SNCM steel or the like. It is desirable that the hardness of the flap 1 is brought to HRc 30 to 65 by hardening treatment or the like. If the hardness of the flap 1 is less than HRc 30, it is impossible to obtain a sufficient strength, while, if the hardness is higher than HRc 65, forming of the flap 1 becomes difficult.

The dimension or size of the flap 1 varies depending upon the use of the chain cutter. In a case where the flap is utilized in cutting of normal large stone, for example, it is preferable that the flap 1 has its thickness of the order of 2 mm to 6 mm, its height H of the order of 50 mm to 150 mm, and its width $W^i$ of the order of 40 mm to 100 mm. If the dimension of the flap 1 is within these ranges, it is possible to cut a large stone with high efficiency using sufficient tensioning force. In this connection, the invention is not limiting to these dimensions quoted.

A connecting structure between each pair of adjacent flaps 1 will next be described. As shown in FIG. 3, each of the side face of the flaps 1 has a circular connecting tab 8, pointing in the direction of the rotation. A circular connecting cut-out 10 is formed at an opposite side face of the flap 1, in the rear direction (or the rear end), having substantially the same dimension as the connecting tab. A line connecting a center O1 of the connecting tab 8 to a center O2 of the connecting cut-out 10 is set parallel to the outer and the inner peripheral ends of the flap 1.

Figure 4:
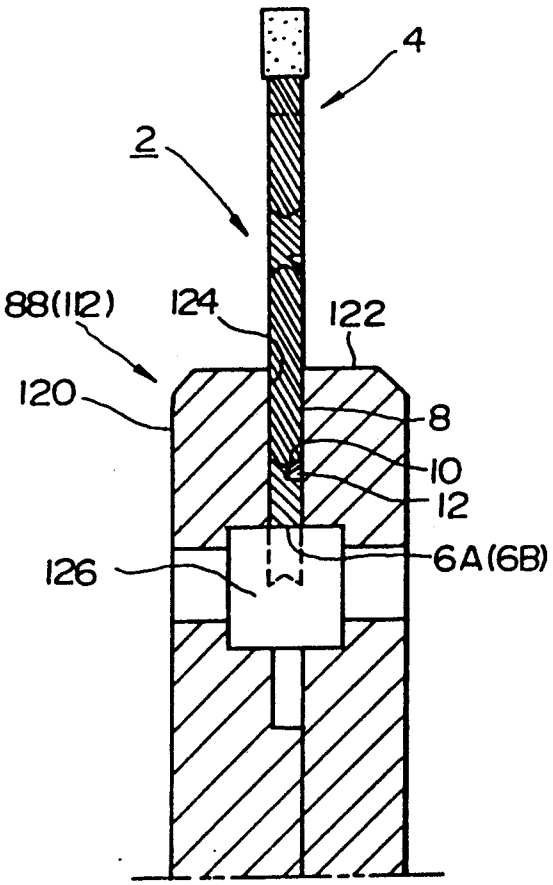
Figure 6:
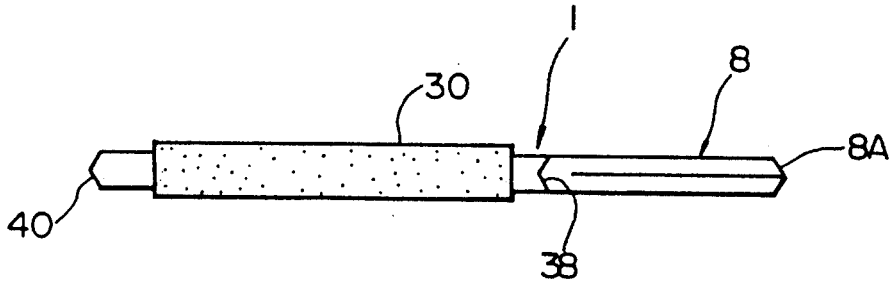

The connecting tab 8 has its outer peripheral surface 8A whose cross-sectional shape is, as shown in FIG. 4, a V-shaped convex configuration along its entire periphery. It is preferable that the V-shaped configuration has a cross-sectional angle of the order of 60° to 170°. If the cross-sectional angle is less than 60°, it is difficult to form the outer peripheral surface 8A, and the connecting strength is reduced, while, if the cross-sectional angle is larger than 170°, there is a chance that the flaps disengage in the thickness direction of the flap 1.

Figure 5:
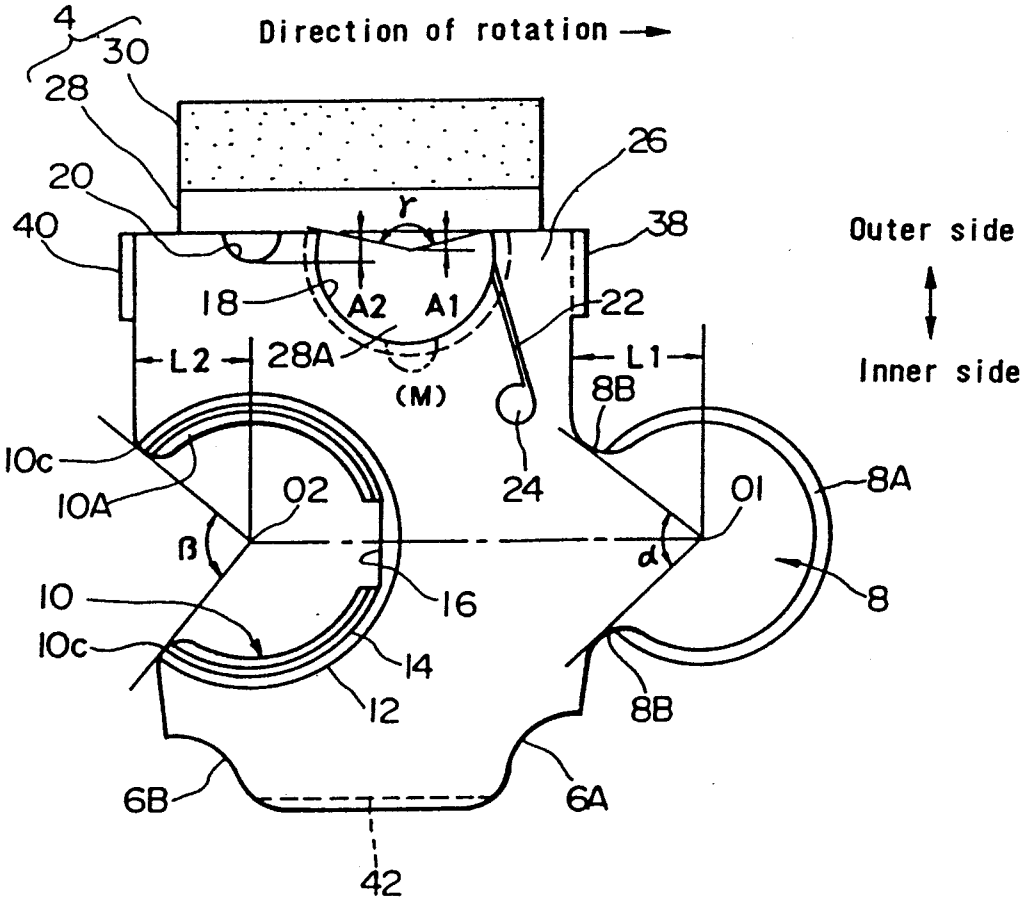

On the other hand, the peripheral surface of the connecting cut-out 10 has a tapered region 10A in a half section extending away from the center of the thickness of the flap 1 (in a direction away from the viewer) as shown in FIG. 5 (and further in FIGS. 7, 10, 11 and 12). The configuration of the tapered surface 10A is complementary in cross-sectional configuration with the connecting tab 8. On the other hand, a portion of the peripheral surface of the connecting cut-out 10, which extends from the aforesaid thickness center to the front surface (towards the viewer) of the flap, is given a designation 10B and is perpendicular to the front face. The cross sectional shapes can be seen in FIG. 7. The diameter of the cut-out 10B is only slightly larger than the maximum diameter of the connecting tab 8.

Further, on the front surface of the flap 1, there is formed a staking (tightening) groove 12 at a location slightly spaced away from the connecting cut-out 10.

Figure 10:
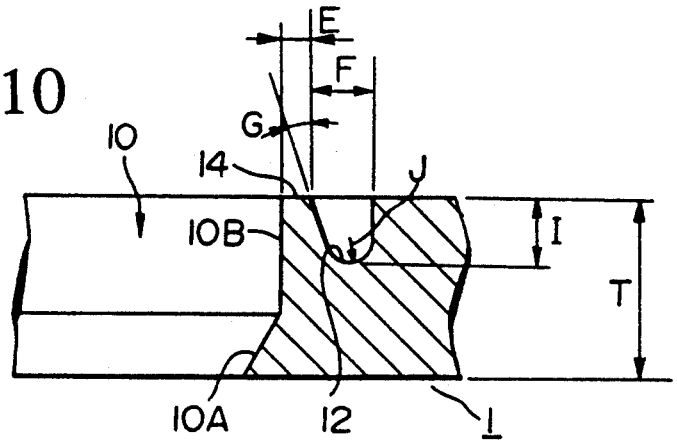
FIG. 10 to FIG. 12 are enlarged cross-sectional illustrations of a connecting method.

As shown in FIG. 10, it is desirable that a value of spacing E from the vertical wall surface 10B to the staking groove 12 is of the order of 0.5 mm to T mm (= the flap thickness), preferably, of the order of 0.5 mm to 3 mm. If the spacing E is equal to or larger than T mm, the staking operation subsequently to be described will become difficult, while, if the quantity of spacing E is less than 0.5 mm, the holding pressure of the connection becomes insufficient.

The staking groove 12 has its opening width F of 1 mm to T mm, desirably, of 1 mm to 5 mm. If the opening width F is within this range, the staking operation will become easy in practice, and there is no fear of reduction of the holding strength at this portion.

The staking groove 12 (FIGS. 10, 11 and 12) has a portion of its wall surface adjacent to the vertical wall 10B, tapered along the entire length. It is desirable that an angle G between the tapered surface and the vertical line of the groove is 10° to 45°. If the angle is out of this range, the staking operation will become difficult. This angle G is larger than an angle L defined as the angle between the tapered surface 8A of the connecting tab 8 and the vertical line. If G is less than L, it is impossible to practice sufficient tightening.

The staking groove 12 has its depth I which is 30% to 60% of the flap thickness T and, more desirably, 30% to 50% thereof. If the depth I is less than 30%, engagement of the connecting tab 8 due to the staking will become difficult, while, if the depth I is larger than 60%, the holding strength will be reduced.

The reference character P denotes a punch which is used in staking operation and which is firmly mounted to an upper mold of a press machine (not shown). The shape of the lower portion of the punch P is an curved configuration in cross-section to fit in the staking groove 12 along its entire length. The outer peripheral surface side of the punch P is a vertical plane extending in parallel relation to the punch axis, while an inner peripheral surface side of the punch P is a tapered surface. Further, the length-wise cross sectional shape of the lower end of the punch P surface is curved, whose radius of curvature $K^i$ is larger than that of the curvature J (refer to FIG. 10) of the inner bottom surface of the staking groove 12.

Figure 11:
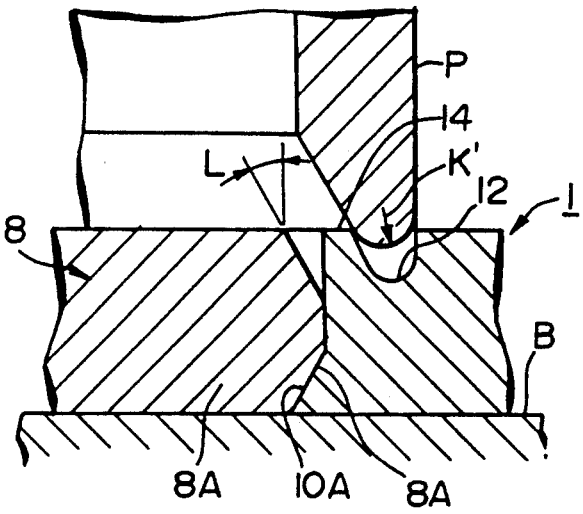
Figure 12:
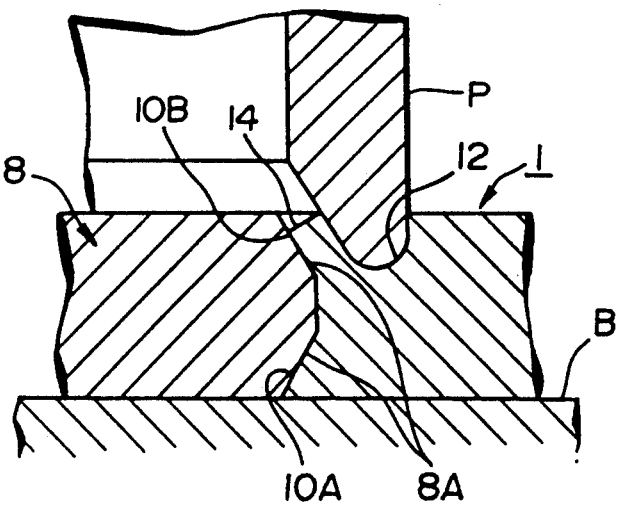

Joining of the flaps 1 is done as follows. That is, as shown in FIG. 11, the flap 1 is made to rest on a base B of the press machine with the staking groove 12 facing upward. The connecting tab 8 of another flap 1 is fitted into the connecting cut-out 10 from the side of the vertical peripheral wall 10B, and the lower end of the punch P is abutted against the staking groove 12. Then, a pressure is applied to the punch P by the press machine. By so doing, the punch P pushes and enlarges the staking groove 12, as shown in FIG. 12. Thus, a ring portion 14 is bent inwardly so that the vertical peripheral surface 10B is abutted tightly against the tapered surface 8A.

Subsequently, when the punch P is moved upwardly, the ring portion 14 slightly rebounds toward its original position elastically, so that an extremely small gap, sufficient to enable sliding movement, is formed between the vertical peripheral surface 10B and the tapered surface 8A. Thus, the connection is completed.

The connecting tab 8 has a pair of constricted portions 8B, all of which are formed respectively into a curved configuration, or neck, as shown in FIG. 5, in order to prevent stress concentration. Further, the connecting cut-out 10 has, at its opening, a pair of side portions 10C each of which is rounded into an curved configuration having its radius of curvature smaller than that of a corresponding the neck of portions 8B.

An angle beta between both ends of the connecting cut-out 10 is 60° to 150°, preferably, 90° to 120°. If the angle beta is greater than 150°, an engaging force of the connecting tab 8 due to the connecting cut-out 10 is so small that the connecting strength is reduced. On the other hand, if the angle beta is smaller than 60°, the width of each of the constricted portions 8B of the connecting tab 8 is so reduced that the strength at this portion is lowered.

A central angle alpha between the constricted portions 8B of the connecting tab 8 is smaller than the central angle beta so that the connecting tab 8 can be rotated within the connecting cut-out 10. Further, a distance L2 from the center O2 of the connecting cut-out 10 to the extension line of the flap end surface is smaller than a distance L1 from the center O1 (FIG. 5) of the connecting tab 8 to the flap end surface.

Figure 13:
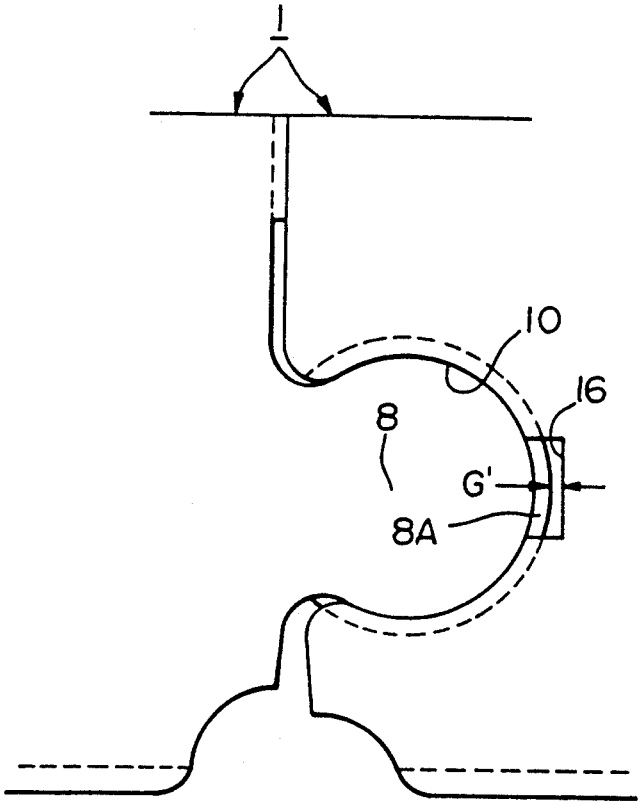
FIG. 13 is a front view of a wear inspecting means for the flaps.

A life gaging mechanism for the flap 1 will next be described. A shallow C-shaped life gaging groove 16 (FIG. 17) is formed at a midpoint of the peripheral edge of the connecting cut-out 10. A distance from the center O2 (FIG. 5) of the connecting cut-out 10 to the bottom surface of the life gaging groove 16 is set slightly larger than the maximum radius of the connecting tab 8. When the flaps are connected to each other, a slight gap is formed (FIG. 13) between the life gaging groove 16 and the outer periphery of the connecting tab 8. If a quantity of the gap is measured by a thickness gage or the like, it is possible to estimate a quantity of wear of the connecting tab 8 and the connecting cut-out 10. Thus, the degree of wear will become a measure of operable life. In this connection, the position of the life gaging groove 16 is not limited to the midpoint of the connecting cut-out 10, but may be any position in the peripheral surface. In this connection, the life gaging groove 16 formed near the midpoint will provides good sensitivity to wear.

Figure 14:
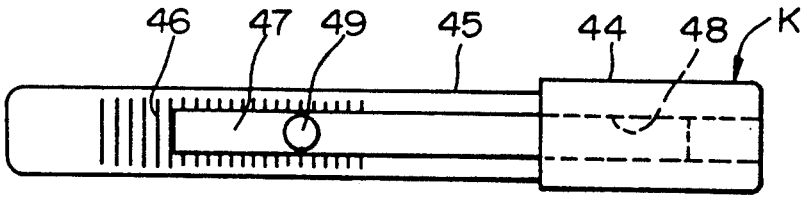
FIGS. 14 and 15 are a plan and a front views of a wear inspecting tool.
Figure 15:
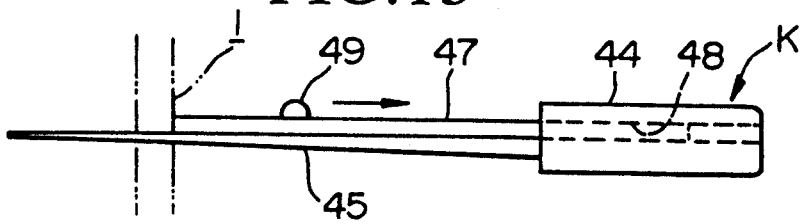

FIGS. 14 and 15 show a thickness gage K which is used for measuring the degree of wear. In these figures, 44 denotes a handle, and 45 designates a tapered portion in the shape of an elongated thin plate firmly mounted to one end of the handle. The tapered portion 45 has its thickness which is smaller, at its forward end, than the aforesaid quantity of gap $G^i$, and which increases gradually toward the handle 44. The tapered portion 45 has its front surface onto which graduations 46 are marked. An elongated plate-like slide bar 47 is arranged along the graduations 46. The slide bar 47 has its rear end inserted in a bore 48 formed in the handle 44. Furthermore, the slide bar 47 has its upper surface which is provided with a projection 49.

In order to inspect the degree of wear at the connections, the tapered portion 45 of the thickness gage K is inserted perpendicularly through the life gaging groove 16. By doing so, the slide bar 47 is abutted against the flap 1 and is moved to the rear, so that the forward end of the slide bar 47 shows on of the graduations 46, which would indicate the quantity of wear.

Figure 17:
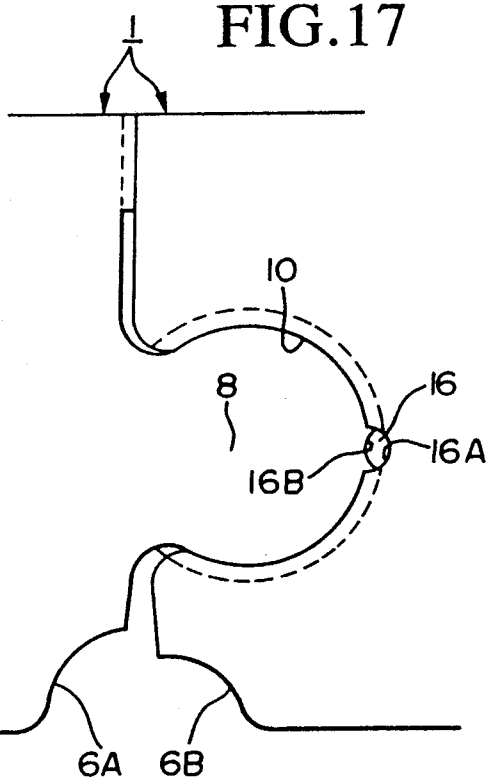
FIG. 16 and FIG. 17 are an illustration of a variation of the above wear inspecting means.
Figure 16:
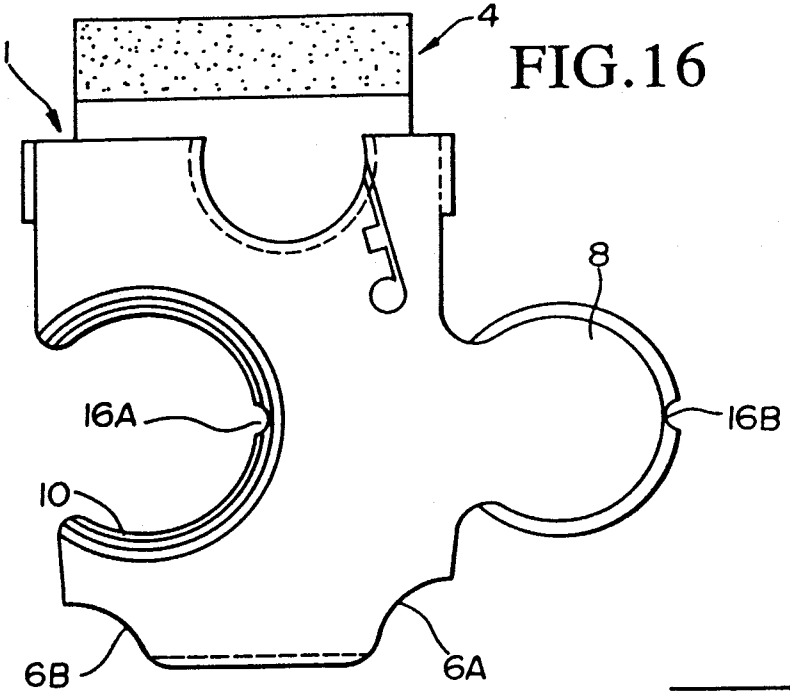

In connection with the above, the arrangement may be such as shown in FIGS. 16 and 17, that a semi-circular recess 16A is formed in the peripheral surface of the connecting cut-out 10, and a semi-circular groove 16B in the peripheral surface of the corresponding connecting tab 8, to form the life gaging bore 16 by these grooves 16A and 16B.

Figure 18:
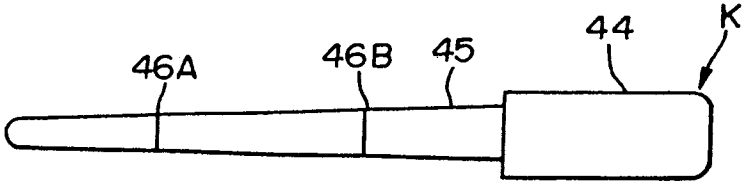
FIG. 18 is a plan view of a tool designed for the method in FIG. 16.

In this case, the thickness gage K having the rod-like tapered portion 45 as shown in FIG. 18 is used, and the tapered portion 45 is inserted into the jig inserting bore 16, to compare the insertion depth with graduations 46A and 46B. The graduations 46A indicate the quantity of new gap of the flap 1, while the graduations 46B indicate the size of the gap at the limit of use.

A fixation method of the cutting device 4 will next be described. As shown in FIG. 5, on the outer end face of each flap 1 is formed a semi-circular segment-mounting recess 18 at an off-center location nearer to the forward direction. The segment-mounting recess 18 has a V-groove cross-section along its entire length. It is preferable that a central angle gamma defined between both ends of the mounting recess 18 is 90° through 170°. Desirably, the central angle gamma is 120° through 160°. If the central angle gamma is less than 90°, mounting and demounting of the cutting device 4 will become difficult, while, if the central angle gamma is larger than 170°, there is a fear that the cutting device 4 will fall off.

Moreover, on the same peripheral side as the mounting recess 18, but off-center to the rear end, there is a vertical jig inserting groove 20 semi-circular in cross-section. The jig inserting groove 20 has its radius A2 (FIG. 5) which is larger than the distance A1 from the center of the mounting recess 18 to the outer end of the flap 1. If the radius A2 is smaller than the distance A1, it is impossible to demount or remove the cutting device 4 by a mounting and demounting jig 32 to be described subsequently. In this connection, the position of the jig inserting groove 20 may be modified or altered to the bottom of the mounting recess as indicated by M in FIG. 5.

Furthermore, the mounting recess 18 is provided with a narrow slit 22, one end of whose opening is directed toward the outer periphery. This end of the slit 22 has one end which opens to a portion of the mounting recess 18 near to the forward edge of the flap 1. The slit 22 has at its terminal end a circular bore 24 for stress relieving. A portion to the forward edge of the slit 22 is an elastic engaging part 26, a deflection of which in the forward direction enables mounting and demounting of the cutting device 4.

The cutting device 4 is composed of a metal chip support 28 having its thickness the same as that of the flap 1, and a rectangular cutting bit 30 firmly mounted to the outer end face of the chip support 28.

The cutting bits 30 has its thickness which is set to be 0.5 mm to 4 mm thicker than the chip support 28. If the excess thickness of the cutting bits 30 is less than 0.5 mm, a possibility exists that the chip support 28 and the flap 1 are in frictional contact with a cut surface of an object. On the other hand, if the excess thickness of the cutting bits 30 is larger than 4 mm, the cutting loss is high and the yield is reduced unnecessarily.

The cutting bit 30 has a metal-bonded abrasive layer containing particles of diamond, CBN or the like, and is firmly mounted to the chip support 28 by means such as soldering, unit sintering, laser welding, electron beam welding or the like. In this connection, the grain or particle size, the degree of concentration and the thickness of the abrasive grains should be determined according to the use of the chain cutter.

The chip support 28 is integrally formed with a semi-disc projection 28A complementary in configuration with the mounting recess 18. The semi-disc projection 28A has a convex V-shaped cross-sectional configuration. The projection 28A is formed so that the projection 28A can be fitted in the segment-mounting recess 18 when the slit 22 is opened, and the projection 28A is firmly engaged in the segment-mounting recess 18 when the elastic engaging part 26 returns to its original position.

Figure 9:
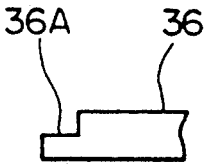
FIGS. 8 and 9 are a plan and a sectional front views of mounting and demounting jig for the flaps.
Figure 8:
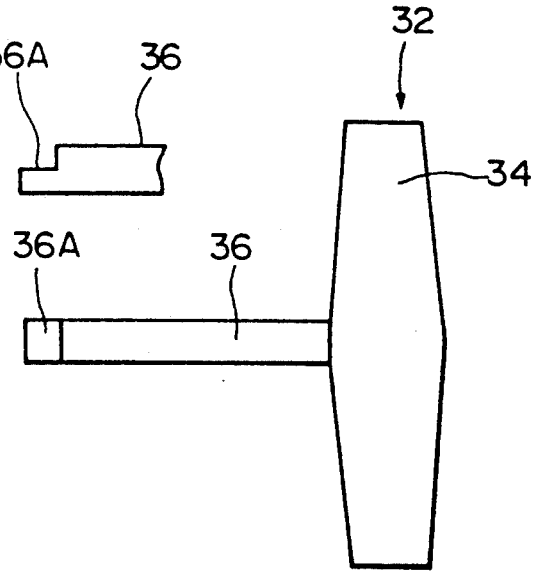
Figure 7:
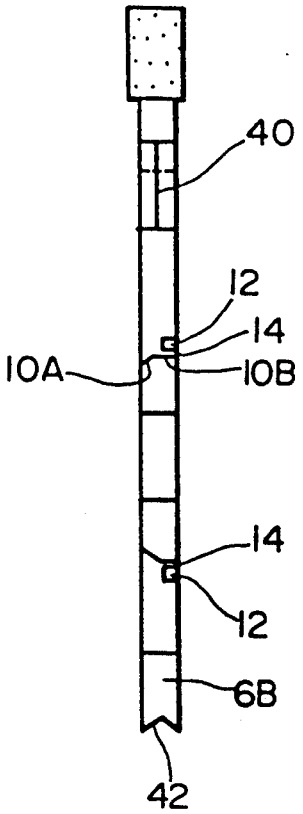

In connection with the above, FIGS. 8 and 9 show the aforesaid mounting and demounting jig 32 which is in the shape of a letter T having a handle 34 and a shaft 36. The shaft 36 has its forward end 36A which is formed into a semi-circle in cross-section identical in size with the jig inserting groove 20. The forward end 36A is inserted in the said groove 20, and the handle 34 is rotated through 90°, whereby the cutting device 4 is released from the engaging force of the elastic engaging part 26.

A torsion- or twist-preventing structure for the flap 1 will next be described. Both the forward and the rear end surfaces of the flap 1, as shown in FIG. 5, are made parallel to each other. On the forward end face of the flap 1 is formed a V-shaped cross-sectional engaging groove 38 extending perpendicularly to the vertical forward end face of the flap 1.

Corresponding to the above tab an engaging projection 40 having its cross-sectional configuration complementary to the aforesaid engaging groove 38 is formed on the opposite side to the foregoing projection 38 of the flap 1. When the flaps are lined up tightly in a straight line next to each other, the engaging groove 38 and the engaging projection 40 of the adjacent flaps 1 are locked together with each other without gap so as to be immovable in the thickness direction of the flap 1.

A structure for driving the chain cutter will next be described. Each flap 1 has, on the forward and rear corners, a pair of driving recesses 6A and 6B.

These driving recesses 6A and 6B are curved in configuration and are disposed respectively at forward and rear corners of the inner peripheral end of each flap 1. Each of the driving recesses 6A and 6B has its central angle which is of the order of 90°.

Each of the driving recesses 6A and 6B (FIG. 3) has its radius of curvature which is identical with a radius of each of pins 126 firmly mounted respectively to outer peripheries of respective sprockets 88 and 112 of a cutting apparatus subsequently to be described. Further, portions extending respectively from the recesses 6A and 6B to the inner end faces of the flap 1 are rounded.

A distance between centers of the respective driving recesses 6A and 6B is equal to a distance between the pins 126. Under the condition that the flaps 1 are wound around the outer peripheries of the respective sprockets 88 and 112, the driving recesses 6A and 6B of the adjacent respective flaps 1 produce an identical curved surface, and the pins 126 are so arranged as to fit in the curved surface without gap.

An engaging structure with respect to a back plate 118 subsequently to be described will next be described. The inner end face of each flap 1 is formed with a sliding groove 42 having in a V-shaped cross-section, which extends along the entire length of the end face of the flap 1. It is desirable that the angle of the V shaped sliding groove 42 is in a range of 60° to 160°. If the V-angle is smaller than 60°, there is a fear that cracks occur in the flap 1 due to a wedging action of the back plate 118, while, if the V-angle is larger than 160°, the twist-preventing force due to the back plate 118 in the thickness direction is reduced.

FIGS. 1 and 2 will next be utilized to describe the cutting apparatus which uses the above-described chain cutter. In this connection, the descriptions such as the upper, lower, left- and right-hand side used in the following description are in reference to the orientation of the cutting apparatus as shown in FIG. 1.

The reference numeral 50 in the figures denote a pair of columns spaced apart suitably to provide the main support to the cutting apparatus. As shown in FIG. 2, mounted respectively to these columns 50 are a pair of rectangular base 54A (left-hand side) and 54B (right-hand side) which permit vertical motions along the column 50, but the keys 52 extending through vertically along the column prevent the rotation of the bases about the column.

A top plate 56 is firmly mounted across the upper ends of the respective columns 50 horizontally. An elevating motor 58 is mounted to the left-hand end of the top plate 56. The motor 58 is so designed as to rotate a screw shaft 60 (FIG. 2) arranged along the rear face of the left-hand column 50, through a gearbox (not shown). An elevating element 62 firmly mounted to the rear face of the left-hand base 54A is mounted to the screw shaft 60.

On the other hand, a gearbox 64 (FIG. 1) is firmly mounted to the right-hand end of the top plate 56. A rotor shaft 66 is laid across or extends between the gearbox 64 and the aforesaid gearbox, so that power of the motor 58 is transmitted also to the gearbox 64. The gearbox 64 has its output shaft which is connected to a screw shaft 68 arranged along the rear face of the right-hand column 50. An elevating element 70, which is firmly mounted to the rear face of the right-hand base 54B, is mounted to the screw shaft 68. When the elevating motor 58 is operated, both the bases 54A and 54B are moved vertically while always maintaining the same relative height.

On the front of the left-hand base 54A, is a disc section 74 and a round-shaped groove 72 whose centers are at the center of the front-face. A tilting plate 76 is arranged along the front face of the disc section 74, and a pair of pawl sections 76A formed respectively at both sides of the tilting plate 76 are fitted respectively in both sides of the round-shaped groove 72. The pawl sections 76A are rotated within the round-shaped groove 72, causing the tilting plate 76 to rotate coaxially with the disc section 74.

The tilting plate 76 has on its front face a rectangular guide rail 78 extending in the right- and left- hand direction. The arrangement is as follows. That is, mounted to the guide rail 78 is an L-shaped support plate 80 having its right-hand end bent forwardly so that the L-shaped support plate 80 is movable in the left- and right-hand directions. The support plate 80 is pulled with a constant force to the left by a biasing mechanism (not shown).

Further, the front face of the tilting plate 76 has a center which is formed with a shaft section 82 projecting forwardly. The shaft 82 projects forwardly through an elongated bore 84 which is formed in the support plate 80 and which extends in the left- and right-hand directions. Mounted to the shaft 82 for rotation is a pulley 86 and a sprocket 88 which are connected to each other coaxially.

A drive motor 92 is mounted to the left-hand front side face of the base 54A through an attaching plate 90 adjustable in height. A pulley 94 is firmly mounted to a rotary shaft of the drive motor 92. A belt 96 passes around and extends between the pulley 94 and the aforesaid pulley 86. The tension force of the belt 96 is adjustable by vertically moving the attaching plate 90.

On the other hand, on the front-face of the right-hand base 54B are a pair of curved grooves 98 extending vertically and an circular segmental plate 100 having a uniform width. The pair of curved grooves 98 and the circular segmental plate 100 share the same center of arc as the center of the left-hand sprocket 88.

A support plate 102 is arranged at the front face of the segment section 100. The segment section 100 has its both sides which are formed with a pair of pawl sections 104 inserted respectively in the curved grooves 98. By doing so, the support plate 102 is capable of being inclined through an angle equal to or larger than 5° about the center of the left-hand sprocket 88 along the section 100. If the tilting angle is less than 5°, cutting into the object W will become difficult to start.

The support plate 102 has on its front face a slide-rail 106 extending in the left- and right-hand direction or the lateral direction. A pulley mounting plate 108 is attached to the slide-rail 106 for movement in the left-and right-hand direction. At the front center of the pulley mounting plate 108 is a shaft 110 which extends forwardly and coaxially. A driving sprocket 112 is rotatably mounted to the shaft 110 through a bearing. A hydraulic cylinder 114 is firmly mounted to the right-hand end-face of the support plate 102 and is directed toward the left. The hydraulic cylinder 114 has its rod which is connected to the pulley mounting plate 108.

In connection with the above, an operating panel 116 is firmly mounted to the right-hand end face of the right-hand base 54B, and each section is controlled by the operational panel 116.

The left-hand end of the support plate 102 is bent in the forward direction in the shape of a letter L. A rectangular back plate 118 extends between the support plate 102 and the right-hand support plate 80 in a plane common to the sprockets 88 and 112. The back plate 118 is made of a material such as SUP steel, SNCM steel, SKD steel, SK steel, stainless steel or the like. The back plate 118 has its thickness which is the same as the flap 1. Further, the vertical distance of the back plate 118 is made equal to the winding diameter of the chain cutter C which is driven by the sprockets 88 and 112. Furthermore, the upper and lower edges of the back plate 118, along its entire length, are formed respectively into a convex V-shaped cross-section complementary with the sliding groove 42 formed on the inner peripheral end of the chain cutter C.

The chain cutter C extends between and is wound about the sprockets 88 and 112. In the linear section of the chain, the upper and lower edges of the back plate 118 are fitted, respectively, in the sliding grooves 42 and into the flaps 1 for sliding movement.

As shown in FIG. 4, the sprockets 88 and 112 are made with a pair of discs 120 and 122 bonded together to form a slit 124. The slit 124 has its opening width which is slightly larger than the thickness of the flap 1. The plurality of cylindrical pins 126 is firmly mounted to the interior of the slit 124 at equal intervals in the peripheral direction. An occluded angle between the pair of adjacent pins 126 defines a sprocket angle S.

Turning to the bases of the apparatus, on the floor surface is formed a shallow gutter 128 at a location between the columns 50, extending in the front and rear directions. A pair of guide rails 130 is mounted at the center of the gutter 128 in parallel relation to each other. A work platform 134 (hereinafter referred to as table 134) having its lower surface provided with two pairs of wheels 132 rests on the pair of guide rails 130. Further, a traction wire 136 connected to a drive machine (not shown) is connected to the longitudinal ends of the table 134, so that the table 134 is movable along the guide rails 130.

Now, the above-described various devices or instruments are used to cause the chain cutter C to perform cutting in the following manner. First, the elevating motor 58 is operated to move the bases 54A and 54B upwardly, and the object W such as stone or the like resting on the table 134 is positioned longitudinally, i.e. along the chain cutter C.

Subsequently, the support plate 102 is moved downward along the curved plate section 100, to tilt the entirety including the chain cutter C and the back plate 118. The support plate 102 is fixed at this lowered position. Further, the left-hand support plate 80 is adjusted to apply an adequate tension to the back plate 118. The hydraulic cylinder 114 is operated to pull the attaching plate 108 toward the right. In this manner, the tension force of the chain cutter C is set to an adequate value.

Under this condition, the drive motor 92 is operated. The elevating motor 58 is operated while rotating the chain cutter C in the direction shown by the arrows in FIG. 1, to lower the entire chain cutter C at a predetermined cutting speed. Thus, the chain cutter C is cut into the object W from the lowered right-hand corner. If a certain degree of cutting depth is reached in due course, the support plate 102 is raised along the curved plate 100, and the chain cutter C is returned to its horizontal position and is locked in place. Cutting proceeds further until the operation has been completed on the object W.

According to the chain cutter C constructed as above, there are produced the following advantages:

1. Since the thickness of the flap 1 and the backplate 118 is less than that of the cutting device 4, the depth of cut is not restricted by the presence of the sprockets 88 and 112, and the chain cutter is able to cut deeply into the object W. Also, the cutting apparatus does not limit the width of the object, i.e. the size in the direction perpendicular to the cutting plane.

2. Since the plurality of metallic flaps 1, each in the shape of a plane plate, is connected flexibly to form the chain body 2, a sufficient cutting force can be obtained by the chain cutter by using relatively thin cutting device 4, compared with the conventional cutting methods such as larger-diameter metal saw or wire saw. It is also possible to reduce the thickness of the cutting bits 30 as compared with the conventional large-diameter cutting blade, wire saw or the like. Thus, the cutting loss can be reduced, and therefore, the product yield from the object W is improved.

3. Since the flaps 1 are connected to each other for angular movement, stress fatigue is difficult to occur, even in the regions around curved sections such as the sprockets 88 and 112, after prolonged used of the cutter. Therefore, it is possible to use the chain cutter C with a high cutting force, thus permitting higher settings of tension and bite than allowable in conventional cutting methods, leading to improved cutting efficiency.

4. Since a rigid back plate 118 is provided on the inner peripheral end of the chain cutter C, the cutting load is supported mainly by the backplate 118, thus permitting straight-line cutting at high applied load.

5. Since the individual flaps 1 can be added or taken off to change the total length of the chain, the chain length can be easily adjusted to custom requirements.

6. The flaps can be mass produced to lower the overall cost of the equipment as well as the cost of cutting operation.

7. Since the linked chain assembly does not permit deflection in the transverse direction (to the cutting plane), there is little vibration of the individual flaps during cutting, and since the bit 30 cuts into the object while being supported by the flap 1 to keep its straightness, cutting action of the chain is stable and accurate, and the resulting cut surface is smooth and has high plainness. At the same time, since the cutting bit 30 is worn off uniformly along its entire length, the abrasive grains are used efficiently, leading to lower cutting cost.

8. Since the chain cutter C operates in the same plane as the plane of rotation of the sprockets 88 and 112, the equipment space needed is less than that of the conventional cutting means, such as a band saw.

9. Vibration occurring during cutting is attenuated at the connecting sections between the flaps 1, so that noises are lower compared with conventional cutting methods.

10. Since the flap connections wear, the chain gradually lengthens with use to make the chain unusable, there is no danger of sudden breakage of the chain. Therefore, this chain offers a high degree of operational safety in comparison to a wire saw.

11. The cutting device 4 are detachable from the flaps 1 so that the worn cutting bits 30 can be replaced readily while the chain is in the curved region of the cutter without demounting the whole chain from the sprockets 88 and 112, thus permitting improved efficiency of the operation.

12. Since the staking groove 12 is formed around the connecting cut-out 10, and since the ring portion 14 around the groove 12 is bent to lock-in the connecting tab 8, the connecting cut-out 10 and the connecting tab 8 can be made equal in thickness. Accordingly, it is possible to reduce the overall thickness of the chain cutter. Furthermore, since the connecting sections between the respective flaps 1 are made flush with each other, shavings and other machining debris are not easily accumulated on the connecting sections, to cause wear and binding of the mechanisms. Thus, the chain construction is made simple a compared with other connecting structures and the manufacturing cost is low.

13. Since the driving recesses 6A and 6B in the flap 1 are present, idle running by the sprockets 88 and 112 is difficult to occur during the operation so that cutting which presents high cutting resistance can be done without problem. Furthermore, since the driving recesses 6A and 6B are present respectively at both ends of the flap 1 on the inner end, the opening width between the adjacent recesses 6A and 6B is enlarged in the straight line section than in the curved region of the chain cutter C. Therefore pins 126 of the respective rotating sprockets 88 and 112 can enter into and disengage from the recesses 6A and 6B smoothly. Thus, there is no case where the pins 126 interfere with the opening edges of the respective recesses 6A and 6B.

14. Since the engaging groove 38 and the engaging projection 40, which are machined on the opposite sides of the flap 1, mesh with each other in the straight line section of the chain cutter, and since the flaps 1 are firmly mounted on a rigid single plate, distortion of the chain C perpendicular to the cutting plane does not occur, and the cutting accuracy is raised. Furthermore, since the slit 22 of each flap 1 is firmly closed in the straight line section, there is no danger that the cutting device 4 will fall off during cutting.

In connection with the above-described embodiment, the recesses 6A and 6B were formed, respectively, at both sides of the inner face of the flap 1 as an engaging/-driving components. They can be substituted with a semi-circular recess in the center area of the inner face of the flap 1. Moreover, the arrangement may be such that a projection is formed on the inner face of the flap 1 while a recess to mesh with the projection can be formed on suitable locations of the sprocket.

Furthermore, the cutting bit may be firmly mounted to the flap so as to be incapable of being demounted, by means such as brazing or the like. Alternatively, the cutting bit may be firmly mounted by any suitable detachable means.

Further, in the above-described first embodiment, the sliding groove 42 for the backing plate 118 was formed in the flap 1. However, the arrangement may be such that a projection is formed on the end face of the flap 1, while a sliding groove is formed on the end face of the backing plate 118.

Moreover, it is also possible to apply one of the following surface treatments to appropriate portions of the flap 1 or the cutting apparatus, to raise its corrosion resistance and wear resistance.

(a) One or more materials selected from the group consisting of carbides such as TiC, nitrides such as TiN, borides such as BN, oxides such as $Al_2O_3$, and other hard materials such as diamonds, are coated on the entire surface or a sliding surface of the flap 1 by the use of ion plating method, PVD method, CVD method or the like. In this connection, the sliding surface referred here indicates the outer peripheral surface of the connecting tab, the inner peripheral surface of the connecting cut-out 10, the inner surfaces of the respective driving recesses 6A and 6B, the inner surface of the sliding groove 42, the end faces of the back plate 118, the outer peripheral surface of the pin 126, and other surfaces of high wear.

(b) Powder plasma cladding, weld cladding, or the like is used to form a wear-resistant material coating layer such as ceramic, cobalt alloy or the like on the entire surface or the sliding surface of the flap 1.

(c) A thin plate or the like high in wear resistance comprising cemented carbide, high-strength ceramics or the like is firmly mounted to the inner surface of the sliding groove 42 or the end faces of the back plate 118, by attaching means such as brazing, staking fixing or the like. If possible, the thin plate or the like may be firmly mounted to other sliding surfaces.

(d) Kanizen plating, hard chromium plating, nickel plating or the like is applied to the entire surface or the sliding surface of the flap 1.

(e) Nitriding treatment or carburizing treatment is applied to the entire surface or the sliding surface of the flap 1 within a vacuum heat-treatment furnace or the like.

Figure 19:
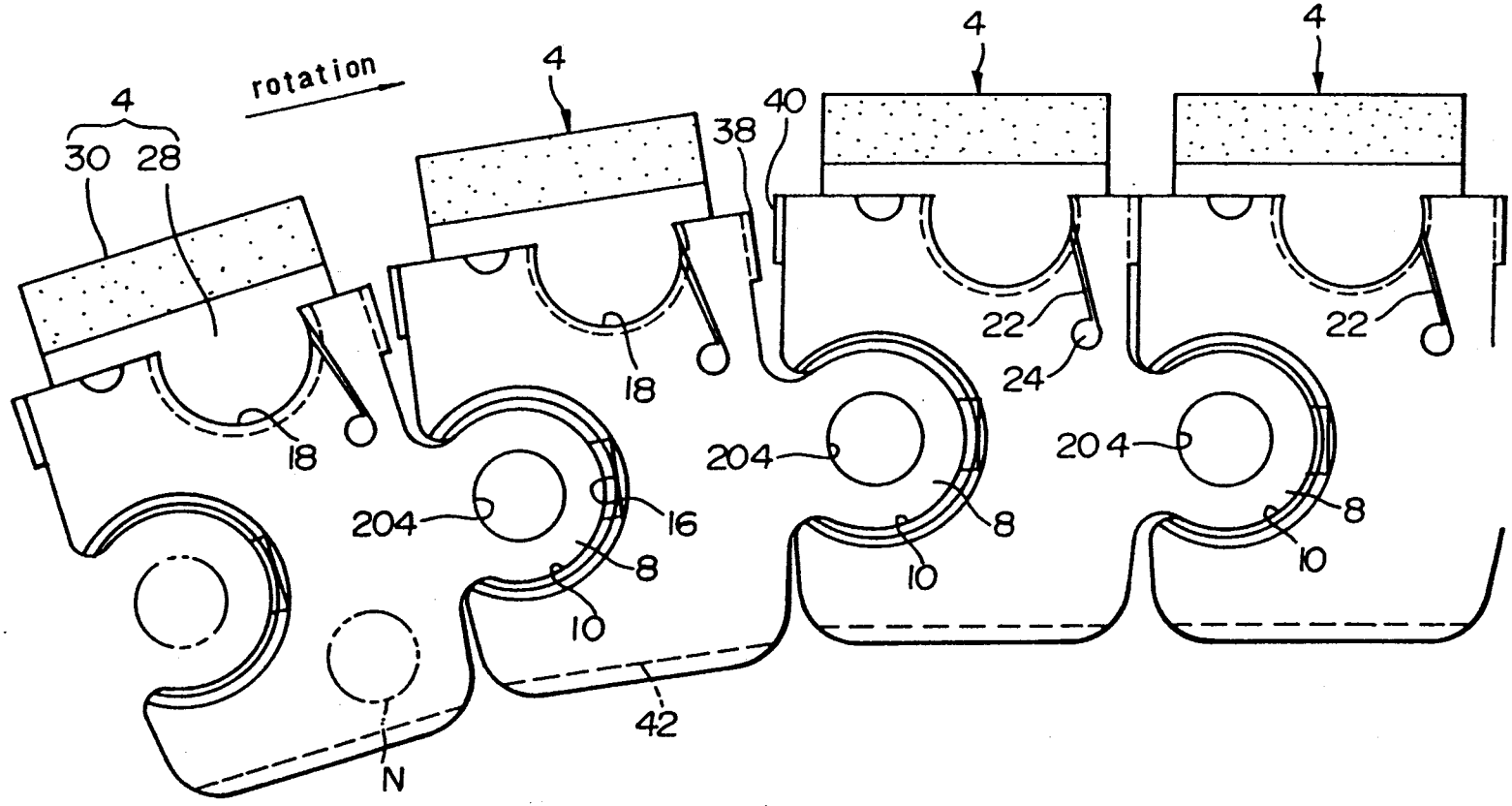
FIG. 19 is a front view of a cutting apparatus used in a second embodiment.

A second embodiment of the invention will be described next with reference to FIG. 19.

The chain cutter is characterized in that, in place of having the driving recesses 6A and 6B in the inner face of the flap 1, a circular through bore 204 is formed at the center of the connecting tab 8 on each flap 1.

Each of the through bores 204 is placed so as not to reduce the strength of the connecting tab 8, and the diameter of this bore is set to a size so that a plurality of drive pins 206 formed on the outer periphery of the sprocket 200 (subsequently to be described) can easily get into and out therefrom, while the sprocket 200 is rotated. The edge of the front surface of the through bore 204 is chamfered so that the drive pin 206 can enter the through bore smoothly from the front surface end of the flap 1. Other constructions are the same as those of the first embodiment.

Figure 20:
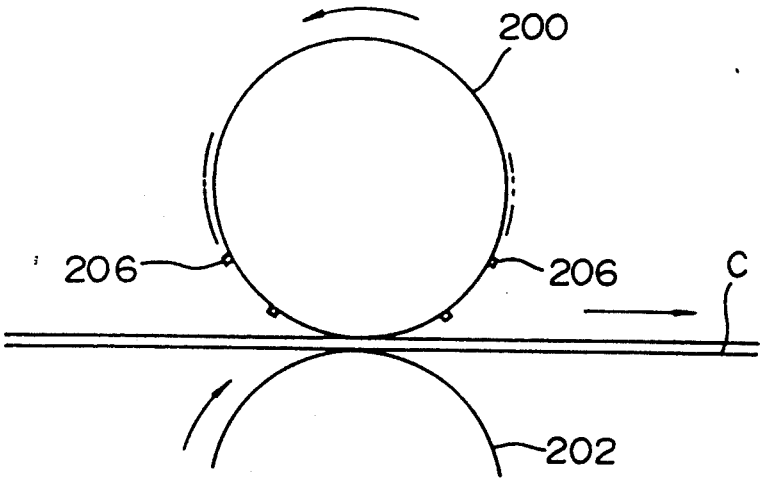
FIG. 20 is a plan view of a driving unit for the above cutting apparatus illustrated in FIG. 19.

The above-described chain cutter is used as follows. The chain cutter is wound on a pair of rotatable pulleys (not shown). Further, as shown in FIG. 20, a pair of drive sprockets 200 and 202 are provided which cooperate with each other to clamp there between the straight line section of the chain cutter C.

One of the pair of drive sprockets 200 has its outer peripheral surface to which the plurality of drive pins 206 are firmly mounted at the same intervals as the through bores 204 in the chain cutter C. The outer peripheral surface of the other drive sprocket 202 is formed into a simple cylindrical surface.

Rotation of each of the sprockets 200 and 202 causes the drive pins 206 to be successively fitted in the through bores 204 to drive the flap 1 and thereby the chain cutter C to perform cutting operation.

In connection with the above, the configuration of the through bore 204 can be modified into an elliptical bore, an elongated bore, a rectangular bore, or the like which extend in the longitudinal direction of the chain cutter C, to facilitate entering of the drive pin 206. Further, the through bore 204 is not limited in its position to the illustrated position, but may be formed in another location which does not affect the strength of the flap 1, as indicated by N in FIG. 19, for example.

Figure 21:
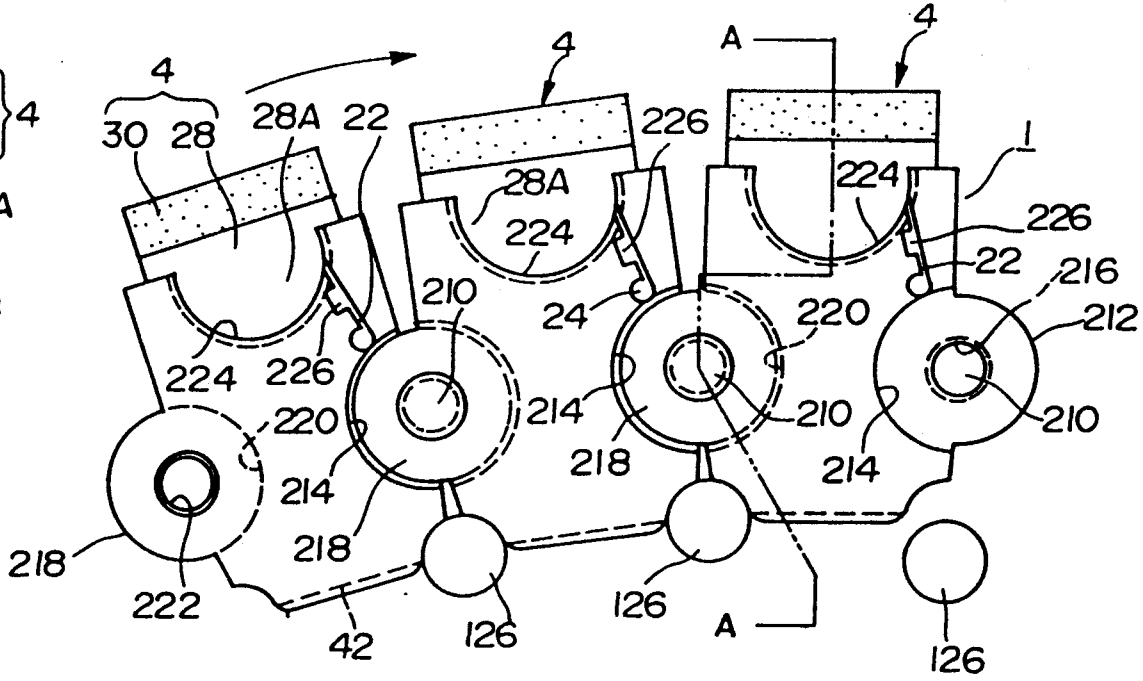
FIGS. 21 and 22 are a sectional front view and a cross-sectional view taken along the line A—A, respectively, from a third embodiment of the invention.
Figure 22:
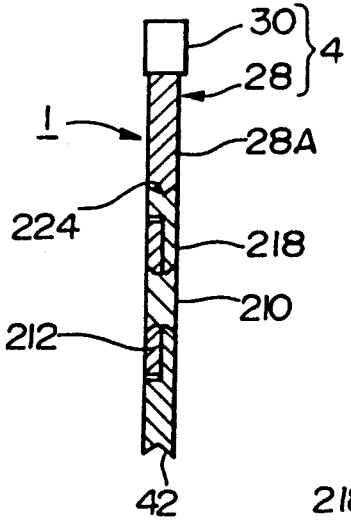

Next, FIGS. 21 and 22 show a third embodiment of the invention. The third embodiment is characterized in that the flaps 1 are connected to each other through a plurality of pins 210 for angular movement.

On one side end of the flap 1 is formed a connecting projection 212 in the shape of a semi-circular tab, having half the thickness of the flap 1. The connecting projection 212 is flush with the rear end of the flap 1. On the forward end of the flap 1 is formed a semi-circular connecting recess 214 which is concentric with the connecting projection 212 and which has its depth equal to half the flap 1 thickness. The connecting recess 214 has its diameter which is slightly larger than that of the connecting projection 212. A circular pin bore 216 is formed at the centers of the respective connecting recess 214 and projection 212. The pin bore 216 has, at its back face side, an opening edge which is chamfered.

On the rear end of the flap 1, there is a similar connecting projection 218 having the same configuration as that described previously. A connecting recess 220 similar to that described above is formed on the back face side of the flap 1. A pin bore 222 is formed at the centers of the respective connecting projection 218 and recess 220, and the entry surfaces of the bore are chamfered. The line joining the centers of the respective connecting projections 212 and 218 of the same flap 1 is parallel to the inner end of the flap 1 and to the cutting surface of the cutting bit 30.

When the connecting projections 212 and the connecting projections 218 of the flaps 1 are concentrically superimposed upon each other, the connecting pins 210 are inserted through the pin bores 222 and 216 of the connecting projections 212 and 218. Both ends of the connecting pin 210 are collapsed and are made flush with the front and rear faces of the flap 1, whereby the connecting projections 212 and 218 are prevented from falling off. The connecting pin 210 is made of material superior in wear resistance and strength such as SKD steel, SNCM steel, or the like.

Further, in this embodiment, a semi-circular segment mounting recess 224 is formed in the center of the outer end of the flap 1, and correspondingly, the configuration of the projection 28A of the bit support 28 is also modified.

Figure 29:
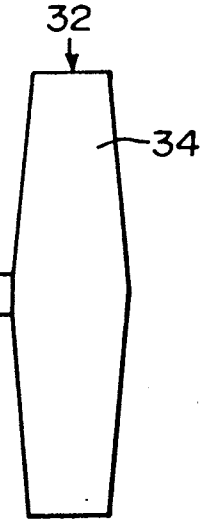
FIGS. 29 through 31 are a top view, a front view of a principal portion, and a left side view, respectively, of a mounting and demounting jig for the flaps illustrated in FIG. 28.
Figure 30:
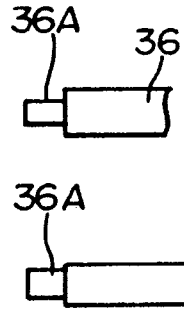
Figure 31:
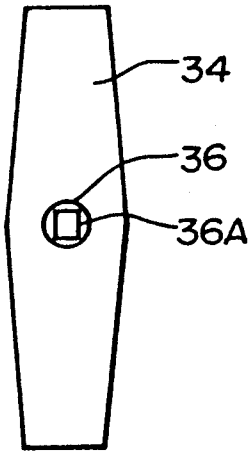

Moreover, a rectangular jig inserting bore 226 is formed at the central region of the slit 22 and, accompanied with this, the mounting and demounting jig 32 is also modified so that, as shown in FIGS. 29 through 31, the tip end 36A of the shaft 36 is formed into a square cross sectional configuration complementary with the jig inserting bore 226.

Furthermore, in this embodiment, dimension is set so that both of the side surfaces of the flaps 1 are abutted against each other in the straight section of the chain. The side surface of the flap 1 is no formed with the twist-preventing engaging sections 38 and 40. This arrangement is also possible.

Figure 23:
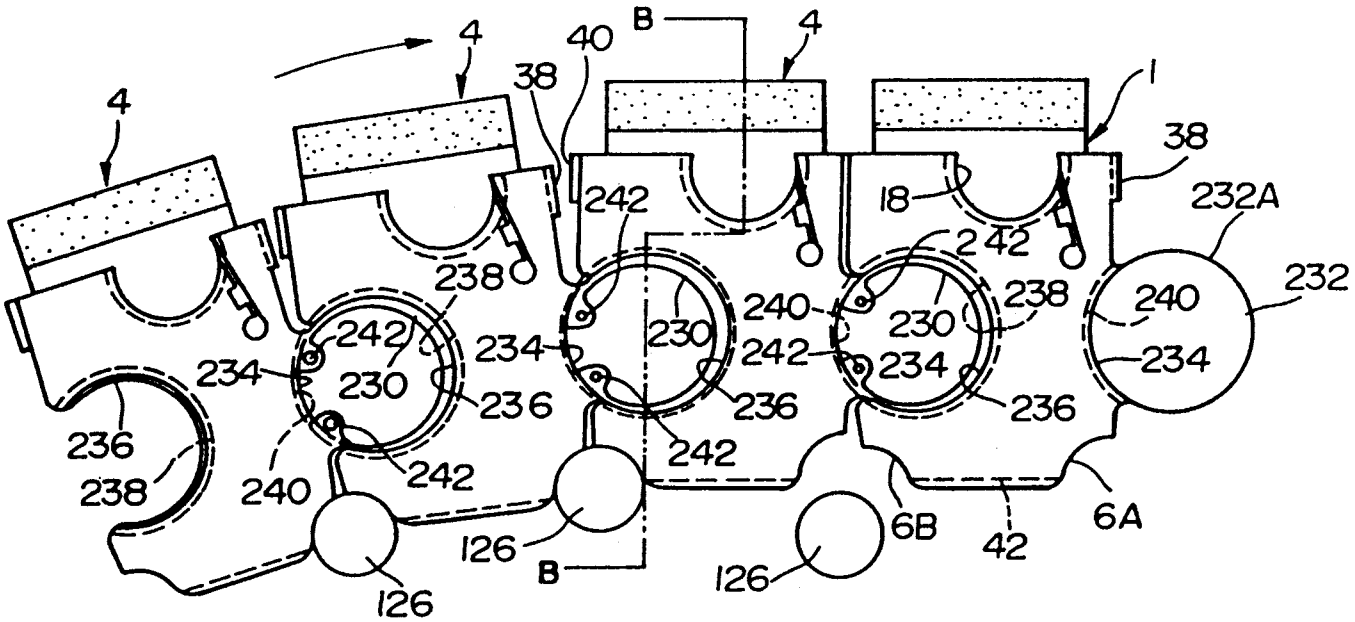
FIGS. 23 and 24 are a sectional front view and a cross-sectional view as viewed from the line B—B of a fourth preferred embodiment.
Figure 24:
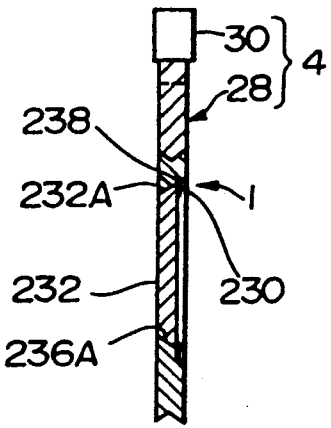

Next, FIGS. 23 and 24 show a fourth embodiment of the invention. This fourth embodiment is characterized in that a plurality of C-rings 230 are used to connect the flaps 1 to each other, thereby easily releasing the connection.

The flap 1 has its one side surface which is formed with a connecting projection 232 similar to the first embodiment. As shown in FIG. 24, however, the thickness of the connecting projection 232 is slightly thinner than that of the flap 1. The flap 1 has its front surface side which is formed with a curved step portion 234 at a root of the connecting projection. Further, the outer peripheral surface of the connecting projection 232 is formed into a tapered surface 232A which is narrowed at the rear face side of the flap along the entire length.

On the other hand, the flap 1 has its other side face which is formed with a connecting cut-out 236 in which the connecting projection 232 is accommodated. The connecting cut-out 236 has its inner peripheral surface which is formed into a tapered surface 236A which is complementary with the aforesaid tapered surface 232A. Furthermore, the tapered surface 236A is formed with a ring groove 238 along the entire length. Further, the above-mentioned step 234 is also formed with an curved ring groove 240 which is contiguous to the aforesaid ring groove 238.

The connecting projection 232 is accommodated in the connecting recess 236, and the C-ring 230 made of a metallic thin plate is accommodated in the aforementioned ring grooves 238 and 240. Thus, the connecting projection 232 permits rotational movement but not the movement in the thickness direction. According to the connecting structure described above, a tip end of a tool is inserted into the holes 242 in the C-ring 230, and the C-ring 230 is squeezed and is removed from the ring grooves 238 and 240, thereby enabling connection between the flaps 1 to be released. Thus, the following advantages are produced. That is, it is possible to easily replace the worn flap 1, or to easily alter the connecting number of the flaps 1 to modify the length of the chain.

In connection with the above, the arrangement may be such that the connecting structure due to the C-ring 230 is applied only to a part of the flap 1, and the aforementioned other connecting structure is applied to the connection of the other flaps 1. By doing so, with the flaps 1 previously connected to each other into a predetermined length serving as a unit, it is possible to replace partially the flaps 1 and to alter the length of the chain.

Further, in place of the C-ring 230, an annular snap ring or the like can be used.

Figure 26:
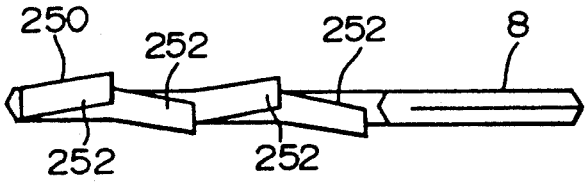
FIGS. 25 through 27 are a front view, a top view and a left side view, respectively, of the flap which is used in a fifth embodiment of the invention.
Figure 27:
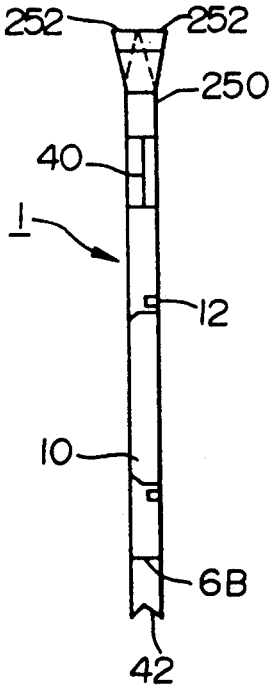
Figure 25:
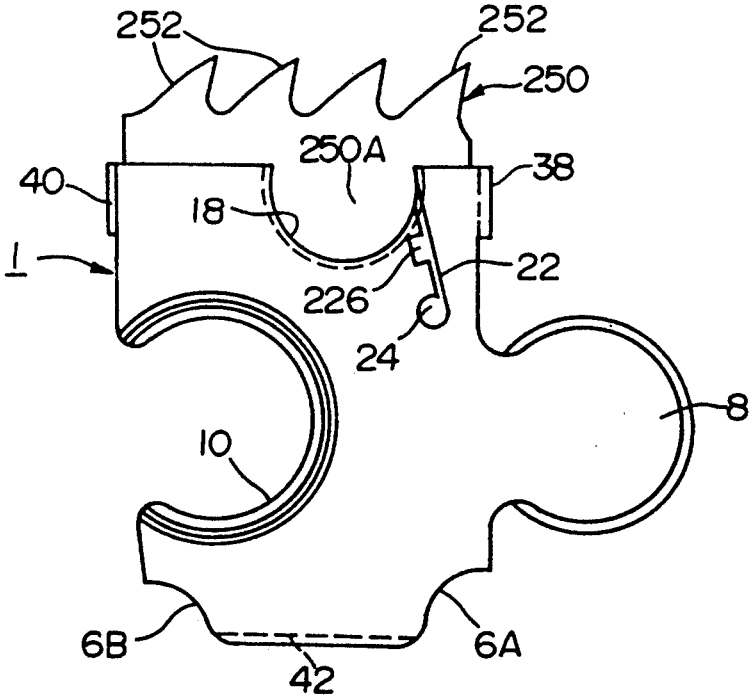

Next, FIGS. 25 through 27 show a part of a chain cutter for wood, according to a fifth embodiment of the invention.

In this fifth embodiment, in place of the aforesaid cutting device 4, a cutting-edge segment 250 is mounted to each of the flaps 1. The flap 1 by itself may be made similar to that described in the previous embodiments.

The cutting-edge segment 250 is made of a material such as SK steel, SKH steel, SKD steel, cemented carbide or the like. The cutting-edge segment 250 has its one end which is formed with saw cutting teeth 252 for wood. The saw cutting teeth 252 are bent alternately in the thickness direction of the flap 1. Further, the other end of the cutting-edge segment 250 is integrally joined with a projection 250A similar to the case of the cutting device 4.

The chain cutter is mounted to the aforesaid cutting apparatus, and is used in cutting of large wood or the like by a method similar to that described previously. If the sharpness or quality of the cutting-edge segment 250 is degraded, the cutting-edge segment 250 can be replaced with new one by the use of the mounting and demounting jig 32 shown in FIGS. 29 through 31, at the curved sections of the chain cutter.

Figure 28:
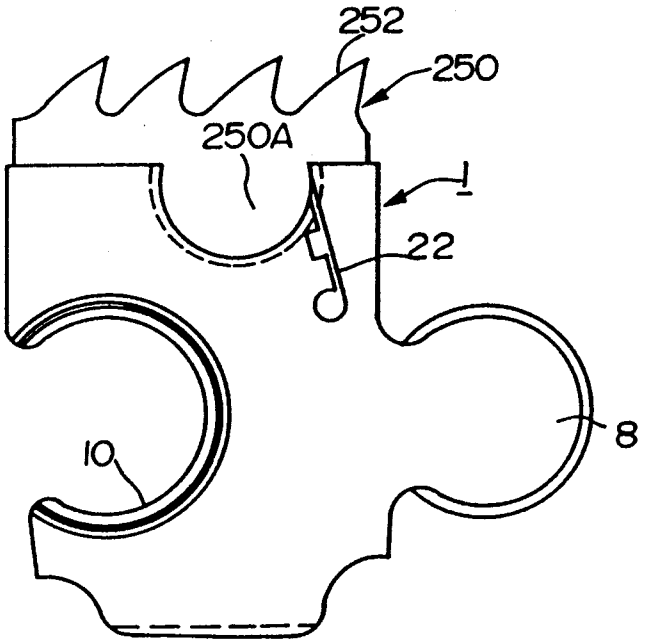
FIG. 28 is a front view showing a modification of the flap according to the fifth embodiment.

In connection with the above, in the case of such chain cutter for wood, as shown in FIG. 28, an arrangement is possible in which the torsion preventing engaging sections 38 and 40 at the respective side surfaces of the flap 1 are omitted.

Figure 33:
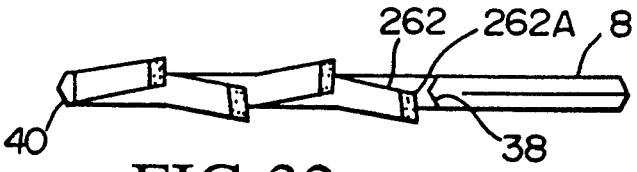
FIGS. 32 through 34 are a front view, a top view and a left side view, respectively, of the flap in a sixth embodiment of the invention.
Figure 34:
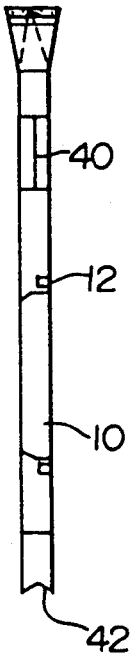
Figure 32:
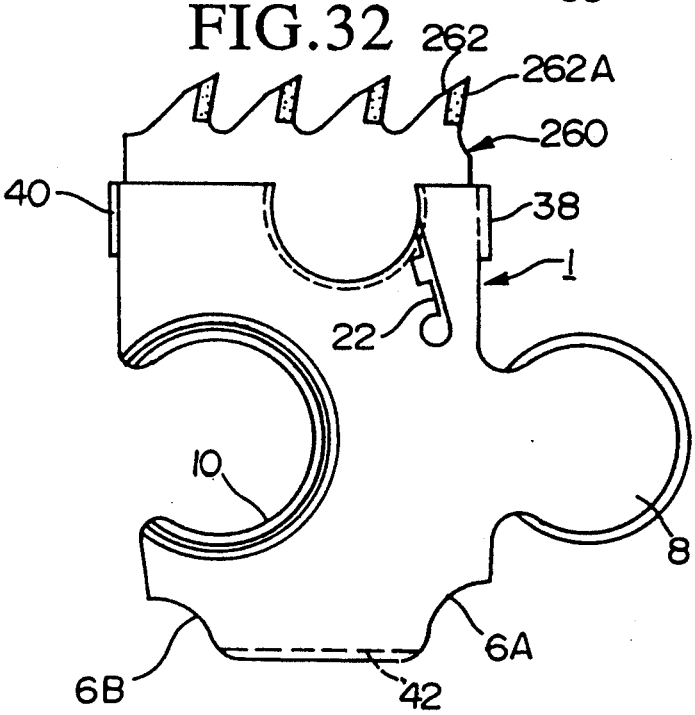

Next, FIGS. 32 through 34 show a chain cutter for wood according to a sixth embodiment of the invention. The sixth embodiment is characterized in that each saw tooth 262 of the cutting-edge segment 260 has a nose section 262A which is formed by a sintered body consisting of diamond, CBN or the like.

Figure 35:
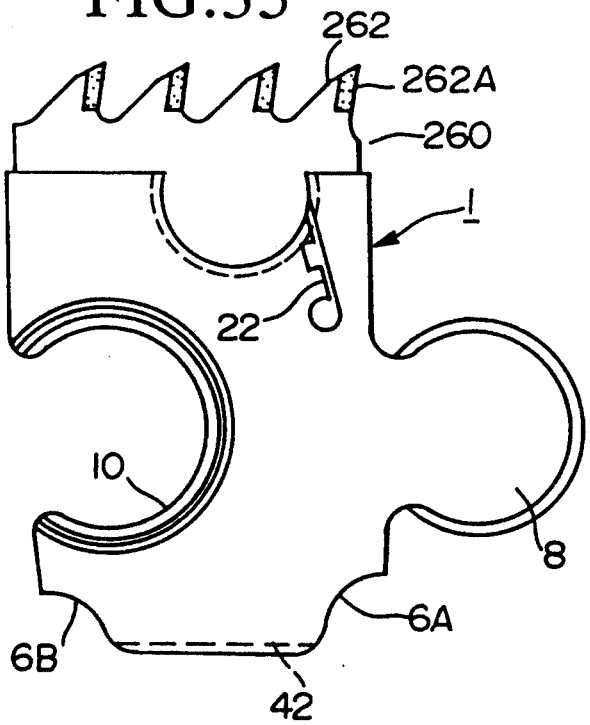
FIG. 35 is a front view showing a modification of the flap.

According to the sixth embodiment, the service life of the cutting-edge segment 260 can considerably be lengthened more than the above-described chain cutter illustrated in FIG. 25, so that it is possible to reduce the replacement frequency of the cutting-edge segment 260 to raise the operational efficiency. Moreover, FIG. 35 shows an example in which the torsion preventing engaging sections 38 and 40 are omitted.

In connection with the above, the configuration of the cutting-edge segment is not limited to the illustrated example, but the pitch, dimension and configuration of the cutting edge may suitably be modified. Further, the arrangement may be such that the cutting-edge segments 250 and 260 are intermittently fixed to the flaps 1, in place of the fact that the cutting-edge segments 250 and 260 are fixed to all the flaps 1.

Figure 36:
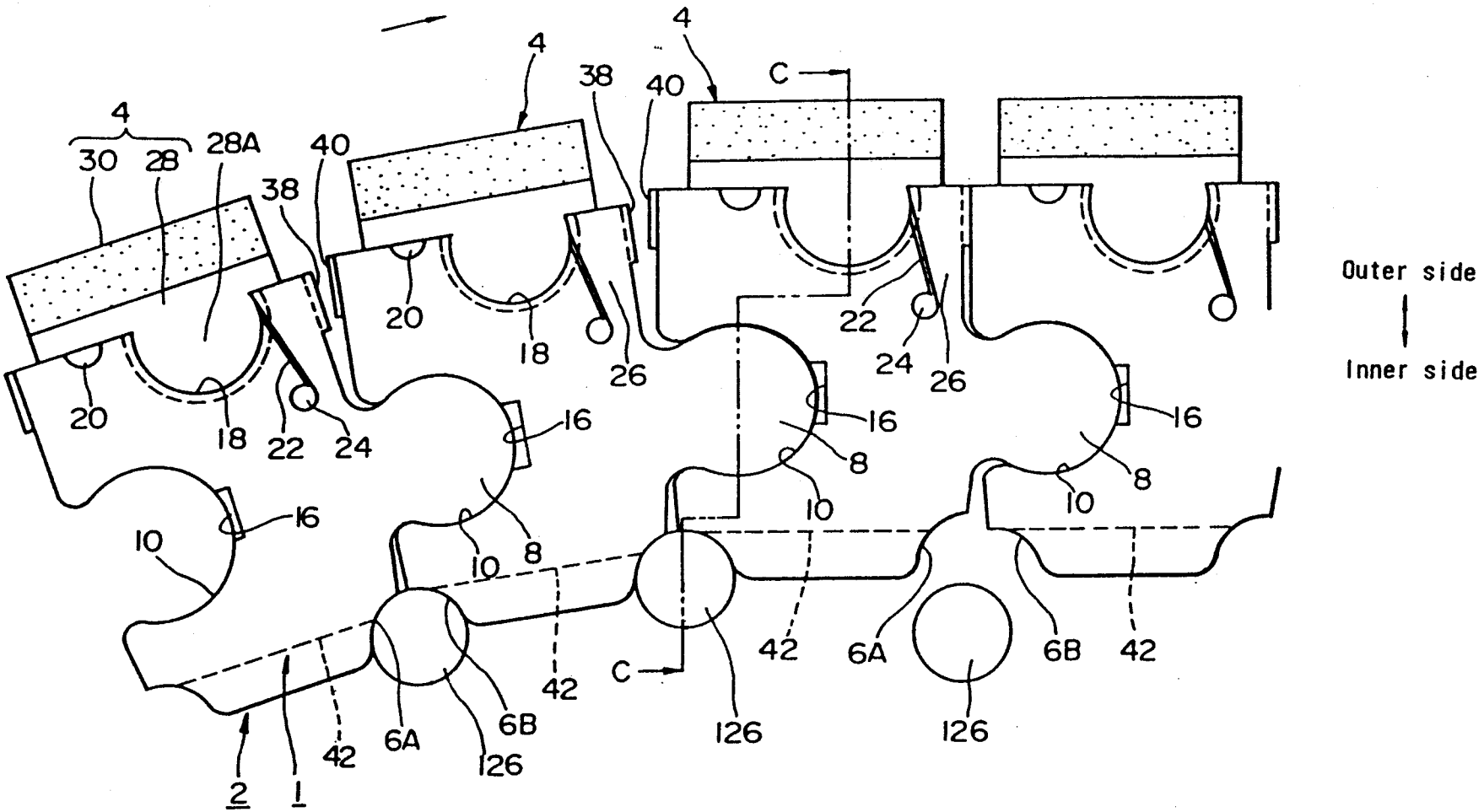
FIGS. 36 and 37 are a sectional front view and a cross-sectional view taken along the line C—C, respectively, from a seventh embodiment of the invention.
Figure 37:
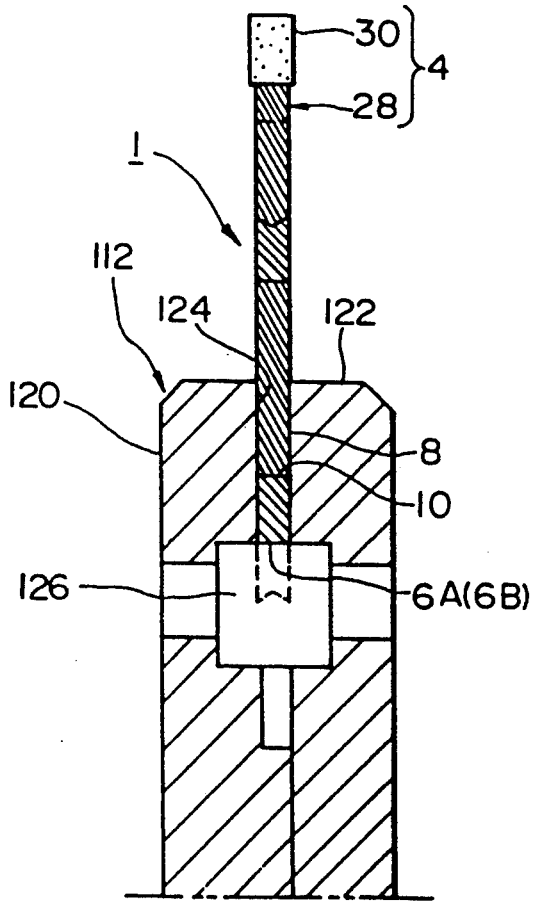

Next, FIG. 36 shows a seventh embodiment which is characterized in that the peripheral surfaces of the connecting tab and the connecting cut-out 10 are formed perpendicular to the flap surface. Further, in the seventh embodiment, the depth of the sliding groove 42 for the back plate is formed deeper than that of each of the aforementioned embodiments.

It is desirable that the sliding groove 42 has its width which is of the order of 30% to 50% of the thickness of the flap from the viewpoint of strength. Furthermore, it is preferable that the sliding groove 42 has its depth which is of the order of 50% to 200% of the thickness of the flap 1, in order that the engaging force of the flap 1 in the thickness direction increases sufficiently.

According to the chain cutter, since the peripheral surfaces of the respective connecting cut-out 10 and tab 8 are configured as simple cylindrical surfaces, mere unfastening of the chain cutter from the back plate 118 and the sprockets 88 and 112 enables each flap 1 to be removed in the thickness direction. Accordingly, replacement of the worn-off flaps 1, alteration in the length of the chain body 2, and so on are practiced extremely easily and quickly.

Further, since the peripheral surfaces of the respective connecting cut-out 10 and tab 8 are configured respectively as peripheral or circumferential surfaces, it is possible to form the flaps 1 with high accuracy by a relatively simple processing method. Thus, the manufacturing cost can be reduced.

Figure 39:
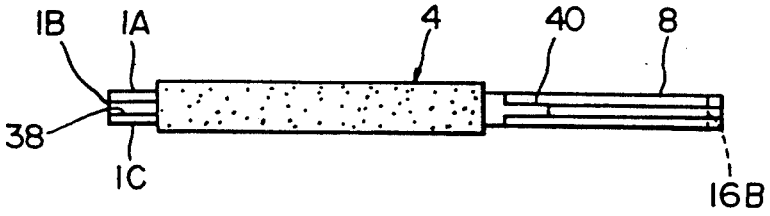
FIGS. 38 through 40 are a front view, a top view and a left side view, respectively, of the flap from an eighth preferred embodiment
Figure 40:
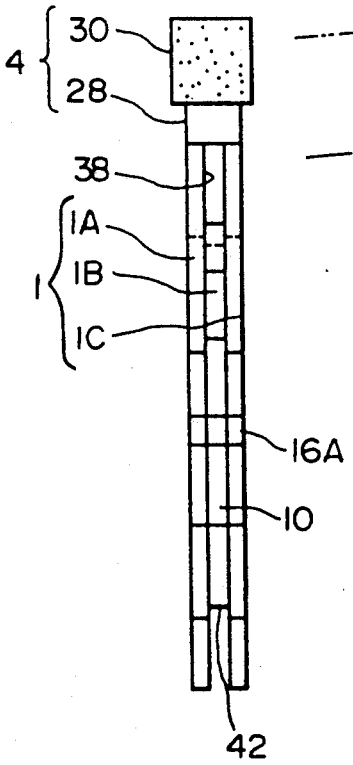
Figure 38:
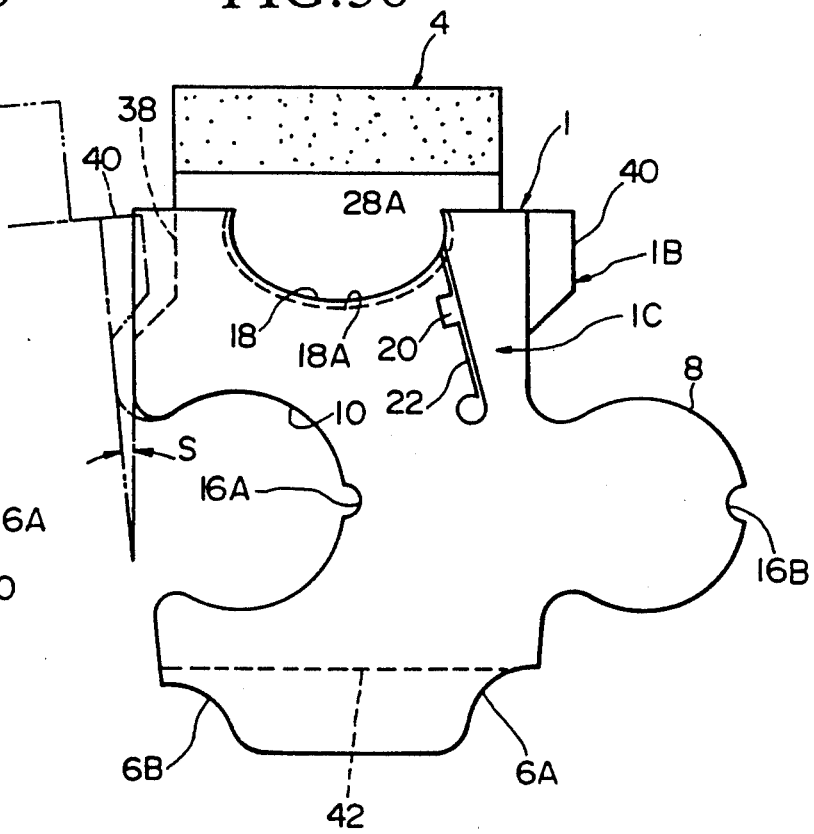

Next, FIGS. 38 through 40 show a chain cutter according to an eighth embodiment of the invention. The chain cutter comprises a plurality of flaps 1, in each of which a pair of outer plates 1A and 1C and an inner plate 1B formed by punching process or the like are bonded to each other in three layers by means of spot welding or the like. The inner plate 1B and the outer plates 1A and 1C have their respective configurations which are partially different from each other, thereby forming the engaging projection 40 and the sliding groove 42 for the back plate, as well as the groove 18A in the segment mounting recess 18, which has a C-shaped cross-sectional configuration.

As shown in FIG. 38, the engaging groove 38 and the engaging projection 40 are engaged with each other against movement in the thickness direction in the case where the connecting angle between the adjacent flaps 1 is equal to or less than the sprocket angle S. When the connecting angle is made slightly larger than the sprocket angle S, the engaging groove 38 and the engaging projection 40 are disengaged from each other.

In the eighth embodiment, the respective configurations of the mounting recess 18 and the mounting projection 28A of the cutting device 4 are modified respectively into elliptical configurations elongated in the connecting direction of the flaps 1.

According to the eighth embodiment, since the flap 1 is made in a three-layer construction, mere punching process and spot welding of the thin plates enable the sliding groove 42, the engaging groove 38, the engaging projection 42 and the groove 18A to be formed easily and at high precision. Thus, it is possible to reduce the processing cost as compared with the construction in which they are formed by grinding processing. Further, since the depths of the respective grooves 38 and 42 and the quantity of projection of the engaging projection 40 are made large, it is possible to raise the torsion preventing effects of the flaps 1 correspondingly.

In connection with the above, in order to replace the flaps 1 by new ones in the above eighth embodiment, the chain cutter C is loosened, and a part of the chain cutter C is bent more than the sprocket angle S. By doing so, the engaging groove 38 and the engaging projection 40 are disengaged from each other, so that it is possible to freely remove the flap 1.

Figure 41:
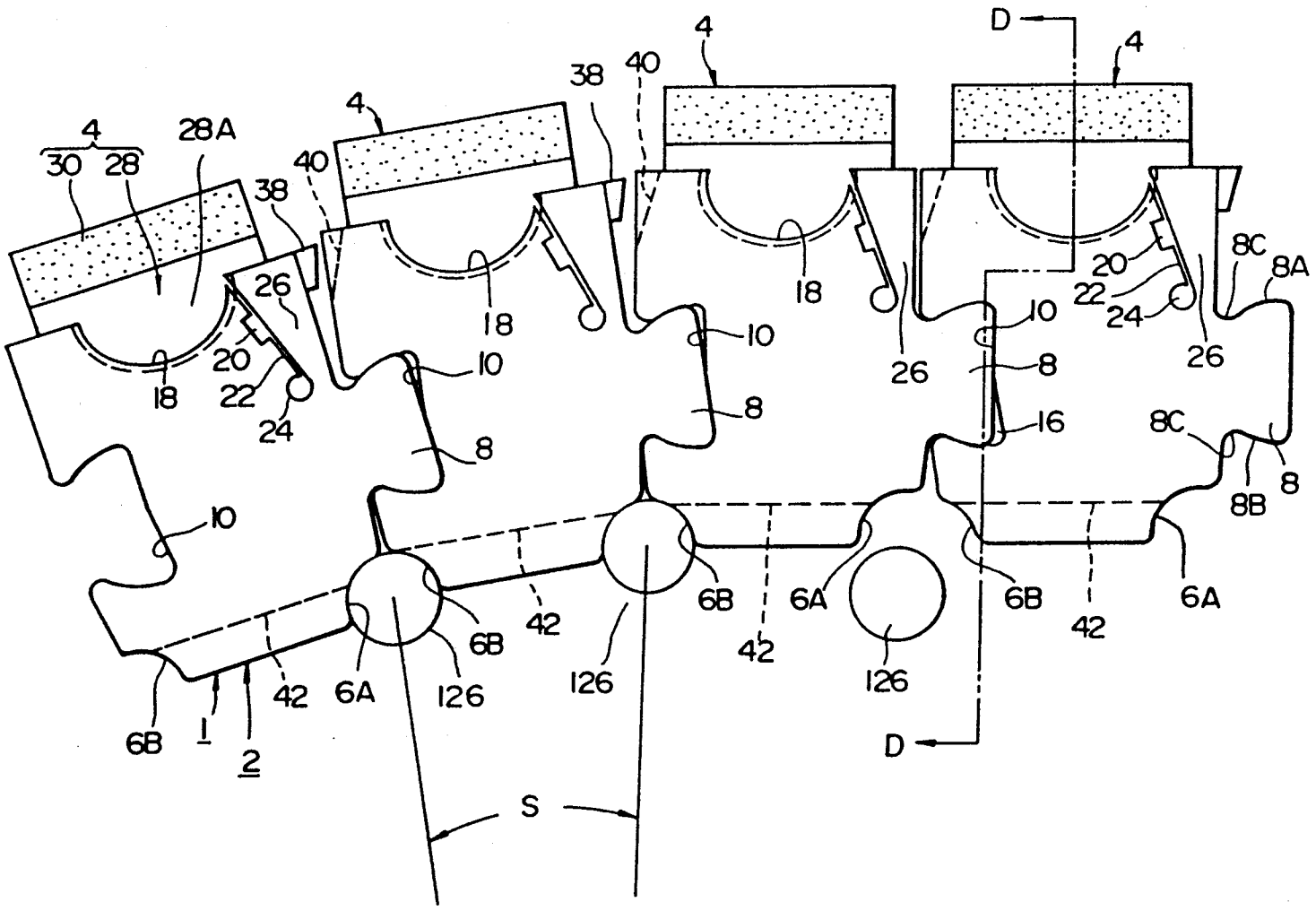
FIGS. 41 and 42 are a sectional front view and a cross-sectional view taken along the line D—D, respectively, from a ninth preferred embodiment of the invention.
Figure 42:
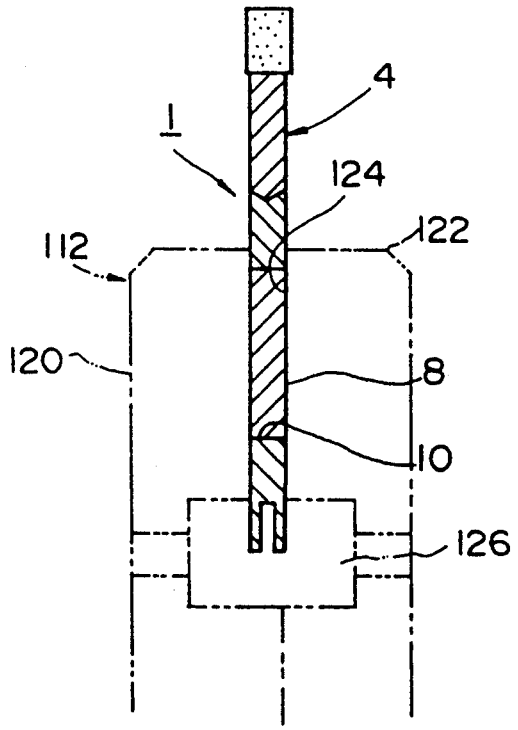

Next, FIGS. 41 and 42 show a ninth embodiment which is characterized in that the connecting tab 8 and the connecting cut-out 10 between each pair of adjacent flaps 1 are formed respectively into a semi-circular configuration.

Figure 43:
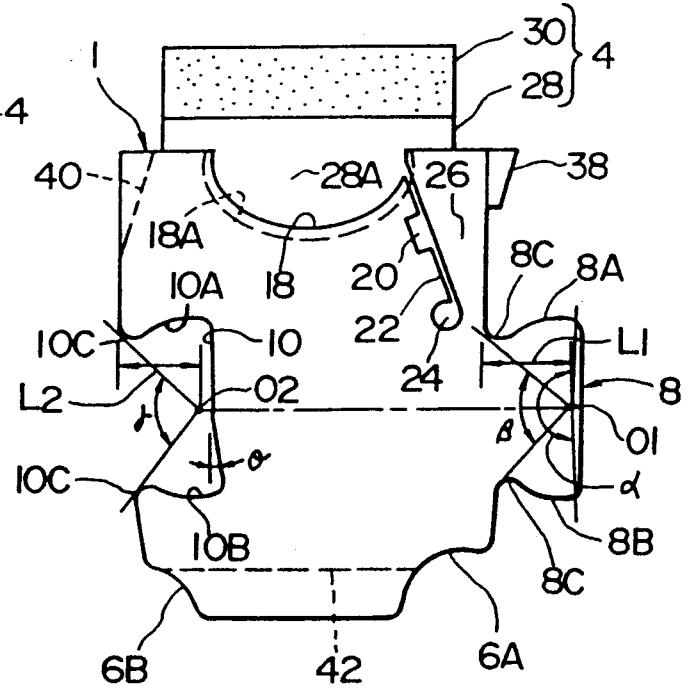
FIGS. 43 and 44 are a front view and a left side view, respectively, of the flap from the ninth preferred embodiment.
Figure 44:
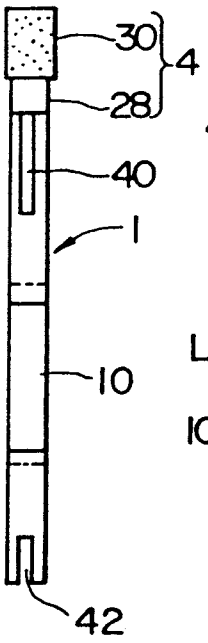

The connecting tab 8 has its peripheral surfaces 8A and 8B at both side edges thereof which are identical in arc with each other. As shown in FIG. 43, the central angle alpha between the peripheral surfaces 8A and 8B is set equal to or larger than 120°. If the central angle alpha is less than 120°, the connecting strength between the flaps 1 is reduced.

The connecting recess 10 has a pair of peripheral surfaces 10A and 10B which corresponds respectively to the aforesaid peripheral surfaces 8A and 8B. The central angle alpha between a pair of opening ends 10C of the connecting cut-out 10 is formed larger than the central angle beta between the pair of constricted sections 8C of the connecting tab 8.

In connection with the above, under the condition that the flaps 1 are connected to each other, a slight gap is left between the connecting cut-out 10 and the connecting tab 8. However, insertion of the thickness gage into the gap enables the quantity of wear of each of the connecting cut-out 10 and the connecting tab 8 to be judged.

According to the ninth embodiment since the connecting tab 8 and the connecting cut-out 10 are made in a semi-circular configuration, the quantity of projection of the connecting tab 8 and the depth of the connecting cut-out 10 can remain small, even if the size of the parts is increased. Accordingly, it is possible to decrease the width of the flap 1 in the connecting direction, and the strength of the connecting cut-out 10 can be raised to improve the connecting strength, to counter the reduction in depth of the connecting cut-out 10.

Figure 45:
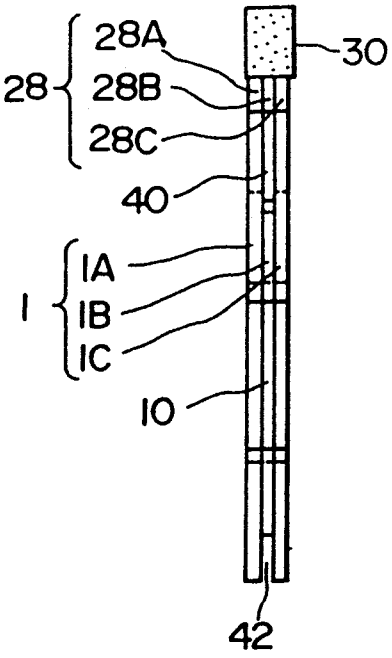
FIG. 45 is a left side view of a modified flap from a ninth preferred embodiment.

In connection with the above, FIG. 45 shows a modification of the above-described ninth embodiment, in which each of the flap 1 and the chip support 28 is formed into a three-layer construction 28A, 28B, 28C.

Figure 46:
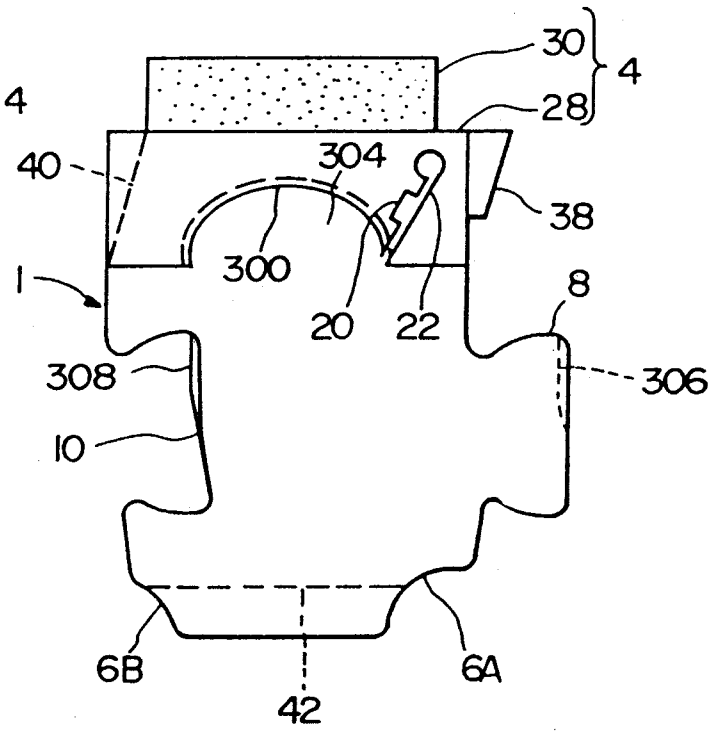
FIGS. 46 and 47 are a front view and a left side, respectively, of the flap from a tenth preferred embodiment.
Figure 47:
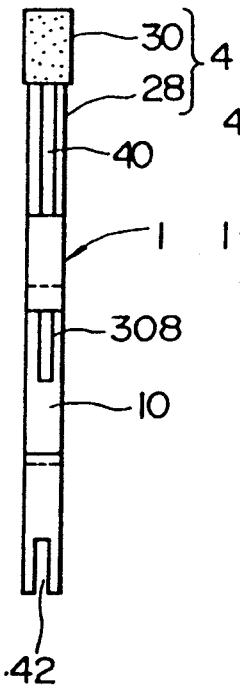

Next, FIGS. 46 and 47 show a tenth embodiment of the invention, which is characterized in that a mounting recess 300 and the slit 22 are formed in the bit support 28 of the cutting device 4, while a mounting projection 304 is formed on the flap 1.

Furthermore, in this tenth embodiment, an engaging groove 306 is formed in the end face of the straight line section of the connecting tab 8. An engaging projection 308 is formed in the end face of the connecting cut-out 10 which corresponds to the engaging groove 306.

According to the tenth embodiment, even in the case where the elastic engaging part 26 is possibly broken or deformed, no effect or influence is imparted upon the flap 1. Since mere replacement of the cutting device 4 by new one completes repair, the service life of the flap 1 can be prolonged.

Figure 48:
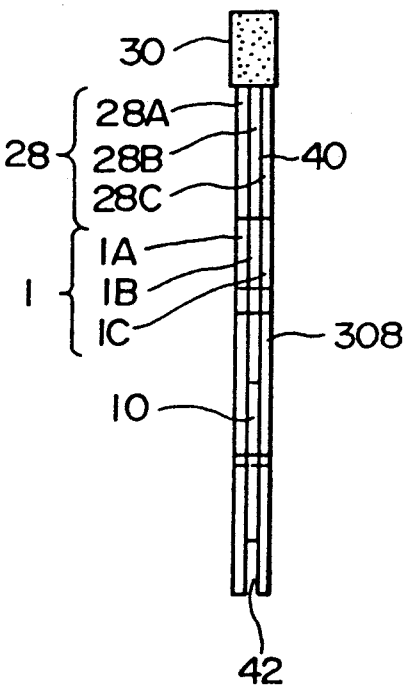
FIG. 48 is a left side view of a modified flap illustrated in FIGS. 46 and 47.

Further, when the chain cutter C is extended in a straight line manner, the engaging projection 308 and the engaging groove 306 of each adjacent flaps 1 are engaged with each other. Thus, torsion of the flaps 1 in the thickness direction is further prevented. Accordingly, the arrangement is also possible in which the engaging projection 38 and the engaging groove 40 for prevention of torsion are omitted. Of course, also in this tenth embodiment, the flap 1 can be brought to a three-layer construction 28A, 28B, 28C, as shown in FIG. 48.

Figure 49:
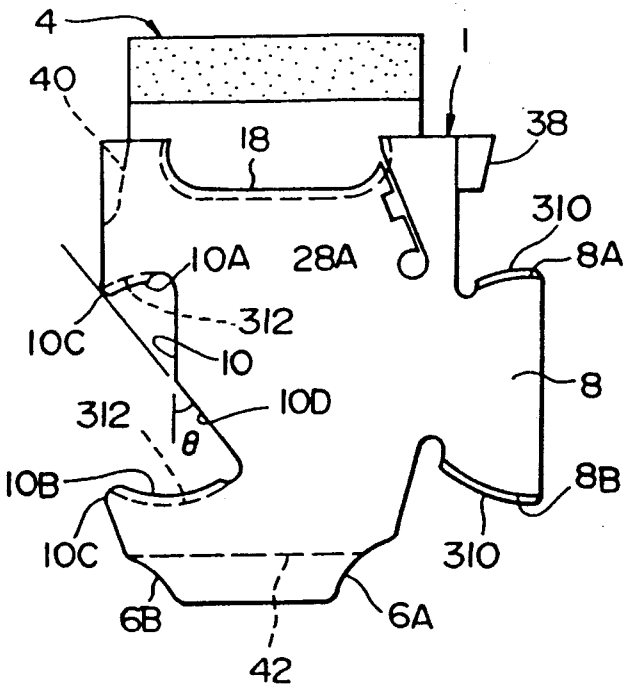
FIGS. 49 and 50 are a front view and a left side view, respectively, of the flap from an eleventh preferred embodiment.
Figure 50:
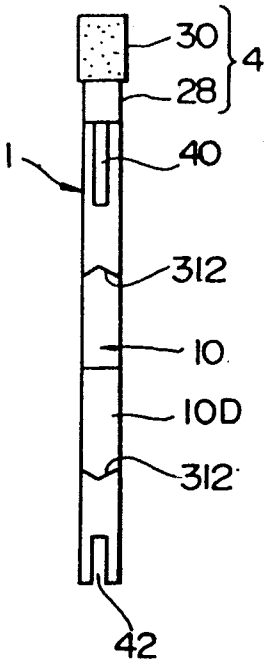

Next, FIGS. 49 and 50 show an eleventh embodiment of the invention. The eleventh embodiment is characterized as follows. That is, a pair of projections 310 and a pair of grooves 312 in the shape of a V-shaped cross-section, complementary with each other, are formed in the respective peripheral surfaces 8A, 8B, 10A and 10B of the connecting tab 8 and the connecting cut-out 10. The projection 310 and the groove 312 are fitted in each other for sliding movement, but against movement in the thickness direction of the flap 1.

An angular-movement angle theta (FIG. 49) of the connecting tab 8 within the connecting cut-out 10 is larger than the sprocket angle S when the flaps 1 are arranged in a straight line manner. An extension line of the end face 10D of the connecting cut-out 10 on the inner peripheral end thereof is set to be in contact with the end face 10C of the connecting cut-out 10 on the outer peripheral end thereof.

Furthermore, in the eleventh embodiment, the mounting projection 28A of the bit support 28 and the mounting recess 18 in the flap 1 have their respective configurations each of which is formed into a shape in which a pair of arc are connected to each other by a straight line. The shape has such an advantage that the mounting recess 18 can easily be processed by an end mill.

According to the eleventh embodiment, since the flaps 1 are prevented from separation in the thickness direction by engagement between the projection 310 and the groove 312, the flaps 1 are difficult to be separated from each other during cutting or transportation of the apparatus.

Figure 52:
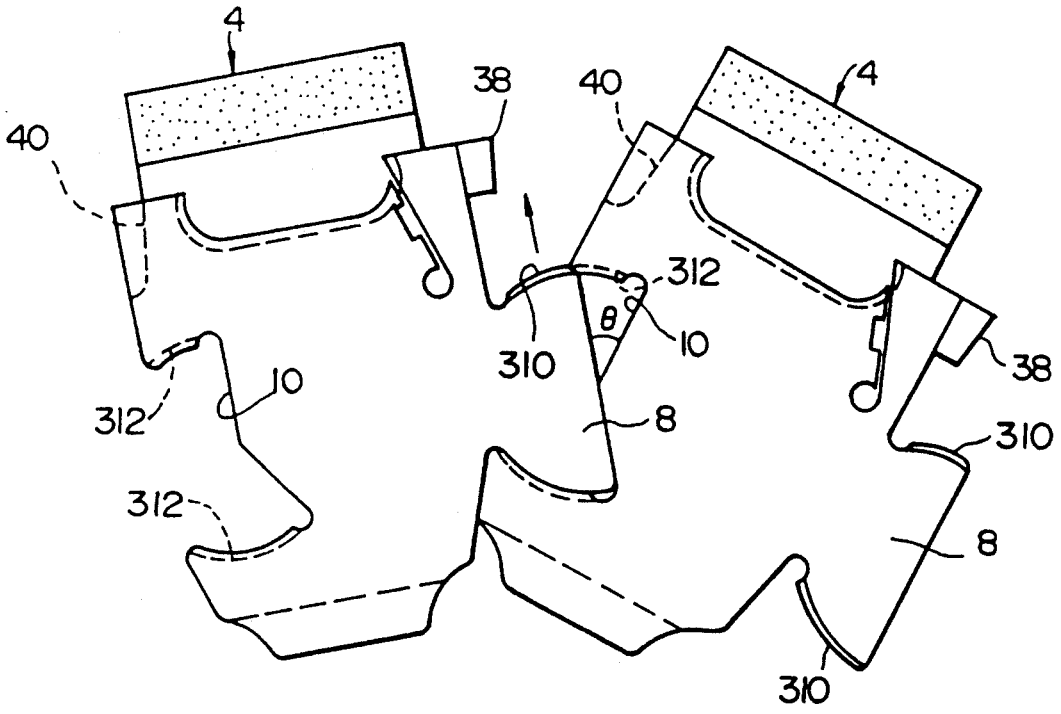
FIG. 52 is a front view showing a mounting and demounting method of a flap of the eleventh preferred embodiment.

On the other hand, when the flaps 1 are replaced by new ones, as shown in FIG. 52, large yielding of the chain cutter C toward the inner periphery enables the connecting tab 8 to be remove from the connecting cut-out 10 in the direction of the arrow. Thus, replacement of the flaps 1 can be done easily and quickly.

Figure 51:
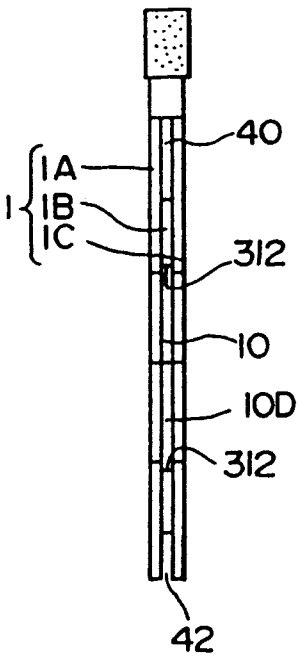
FIG. 51 is a left side view of a modified flap illustrated in FIGS. 49 and 50.

In connection with the above, also in this eleventh embodiment, the flap 1 can be brought to a three-layer construction as shown in FIG. 51.

Figure 53:
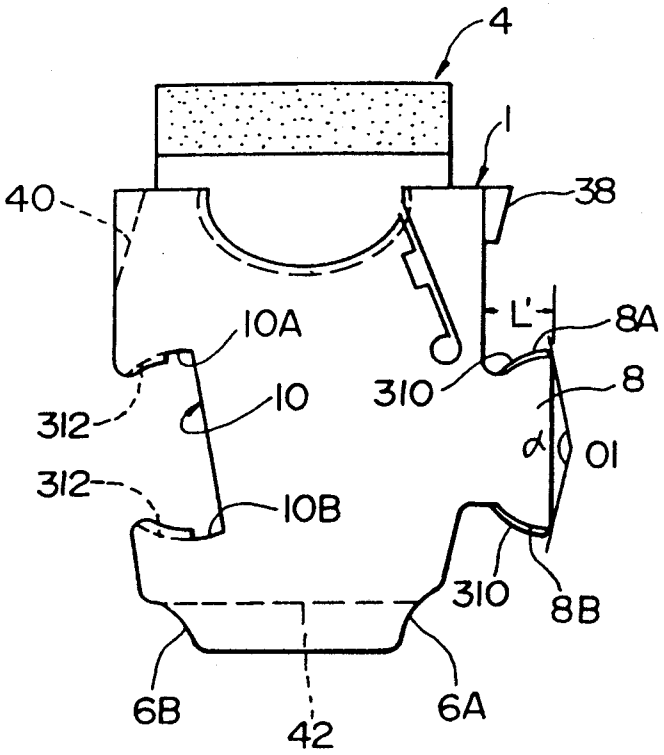
FIGS. 53 and 54 are a front view and a left side view, respectively, of the flap from a twelfth preferred embodiment.
Figure 54:
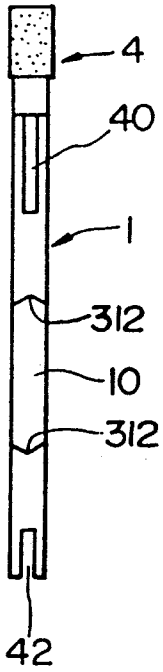

FIGS. 53 and 54 show a twelfth embodiment of the invention. In the twelfth embodiment, the arrangement is such that, as shown in FIG. 53, the size of the projection $L^i$ of the connecting tab 8 does not reach the center O1. Each of the curved peripheral surfaces 8A and 8B is formed with a projection 310, and each of the pair of curved peripheral surfaces 10A and 10B of the connecting cut-out 10 is formed with a groove 312 only at a portion having a predetermined length from the opening edge.

Figure 56:
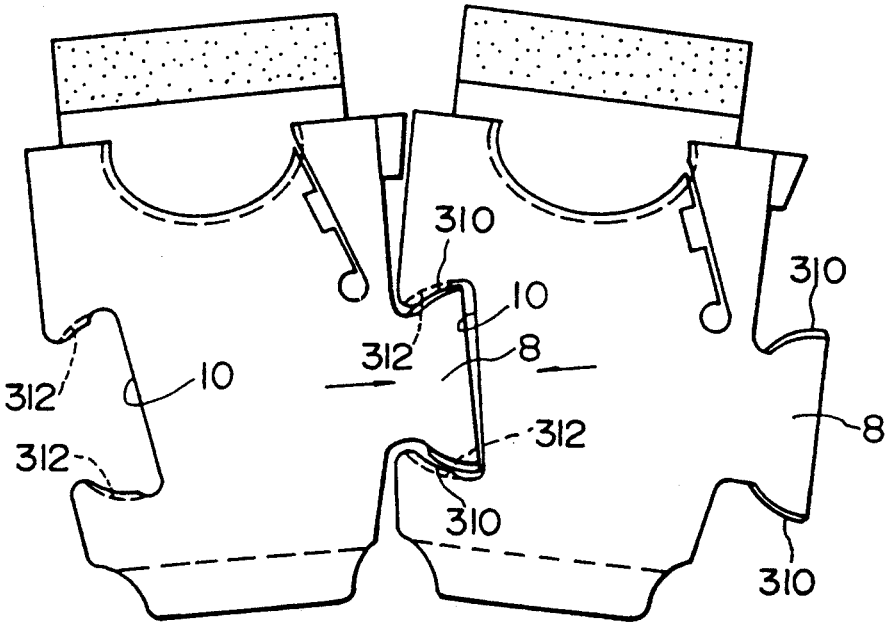
FIG. 56 is a front view showing a mounting and demounting method of the flaps according to the twelfth preferred embodiment.

In this twelfth embodiment, as shown in FIG. 56, shortening of the connecting length of the flaps 1 enables the projection 310 and the groove 312 to be disengaged from each other, making it possible to separate the flaps 1 from each other in the thickness direction.

According to the twelfth embodiment, the flaps 1 are not disconnected from each other regardless of the connecting angle between the flaps 1, during such a period that tension is applied to the flaps 1. Once the chain cutter C is shortened or contracted, however, there is produced an advantage that the flaps 1 can easily be cut off.

Figure 55:
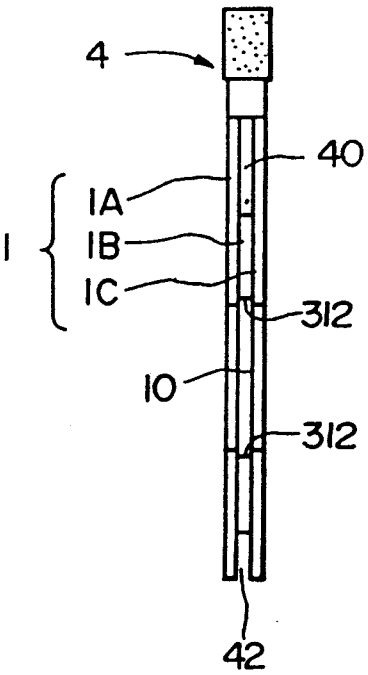
FIG. 55 is a left side view of a modified flap illustrated in FIGS. 53 and 54.

In connection with the above, also in this embodiment, the flap 1 may be formed into a three-layer construction, as shown in FIG. 55.

Furthermore, although, in the above-described twelfth embodiment, the connecting tab 8 has its forward end face which is set to the rear of the curved center O1, it is also possible that the forward end face is set forwardly of the center O1. In this case, the depth of the connecting cut-out 10 should be enlarged, and a room should be formed in which the connecting tab 8 can be moved forwardly within the connecting cut-out 10.

Figure 58:
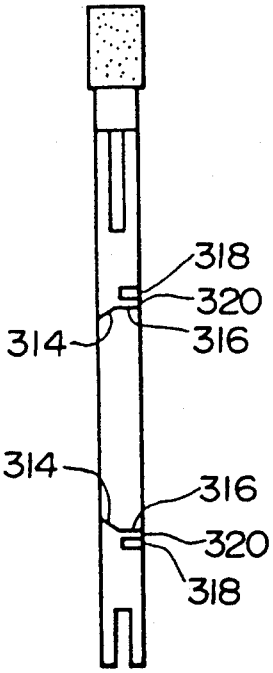
FIGS. 57 and 58 are a front view and a left side view, respectively, of the flap from a thirteenth preferred embodiment.
Figure 57:
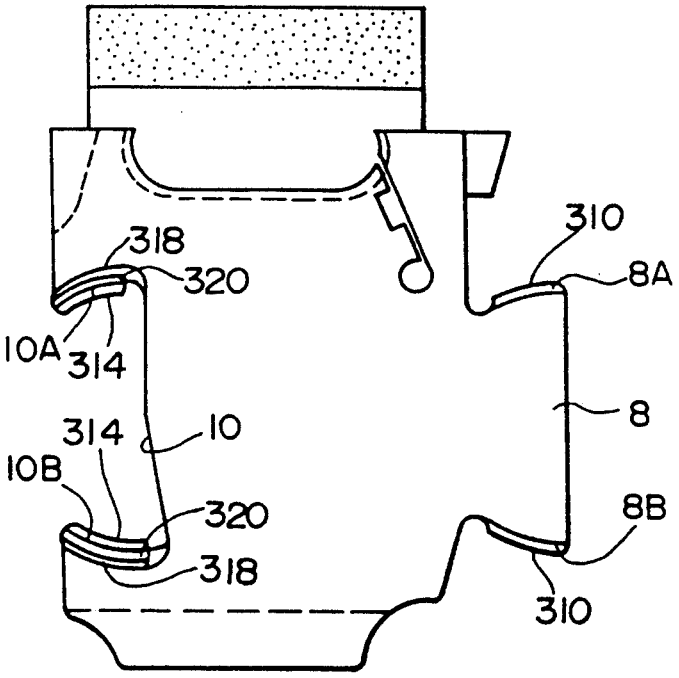

Next, FIGS. 57 and 58 show a thirteenth embodiment of the invention. In the thirteenth embodiment, when the flaps 1 are not connected, the peripheral surfaces 10A and 10B of the connecting cut-out 10 are so that only portions from the thickness center of the flap 1 toward the rear face thereof are made into tapered surfaces 314, while portions from the thickness center toward the front face are made respectively into vertical surfaces 316.

Further, the front face of the flap 1 is formed with a pair of curved staking grooves 318 at their respective remote locations through a predetermined distance from the vertical surface of the connecting cut-out 10.

The connecting tab 8 is fitted in the connecting cut-out 10 from the side of the front face of the flap 1, each of the pair of staking grooves 318 is enlarged along the entire length, and a pair of projecting sections 320 on the insides of the respective staking grooves 318 are deformed inwardly, whereby the connecting tab 8 is supported by the connecting cut-out 10 for angular movement, but against separation in the thickness direction of the flap 1.

According to the thirteenth embodiment, after the chain cutter has been assembled, the connecting tab 8 can not be removed from the connecting cut-out 10, so long as the projection 320 is not deformed. Thus, the thirteenth embodiment is suitable in the case where it is not desirable to have the connection between the flaps 1 become loose during handling.

Figure 59:
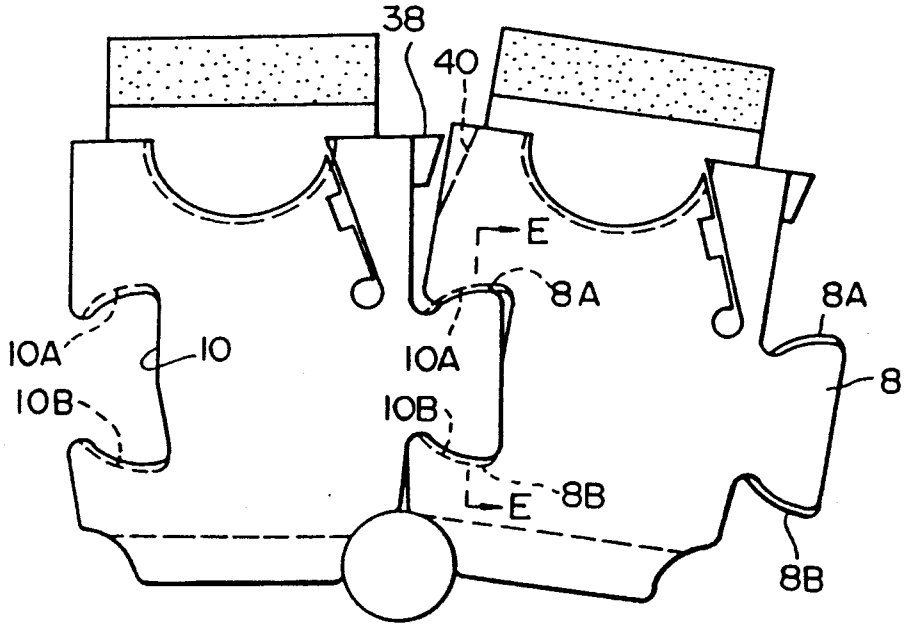
FIG. 59 is a front view of the flap from a fourteenth preferred embodiment.
Figure 60:
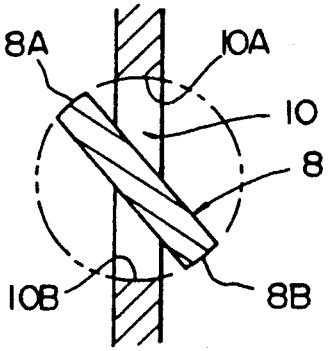
FIG. 60 is a cross-sectional view taken along the line E—E showing a mounting and demounting method for the flaps illustrated in FIG. 59.

Next, FIGS. 59 and 60 show a fourteenth embodiment of the invention, which is characterized in that the curved peripheral surfaces 8A and 8B of the connecting tab 8 and the curved peripheral surfaces 10A and 10B of the connecting cut-out 10 are formed respectively into spherical surfaces which are complementary with each other.

According to the above construction, the engaging groove 40 and the engaging projection 38 of the adjacent flaps 1 are disengaged from each other, and the flap 1 is twisted as shown in FIG. 60, whereby the connecting tab 8 can easily be disengaged from the connecting cut-out 10. Accordingly, replacement of the flaps 1 and adjustment in the length of the chain can easily be done.

Figure 61:
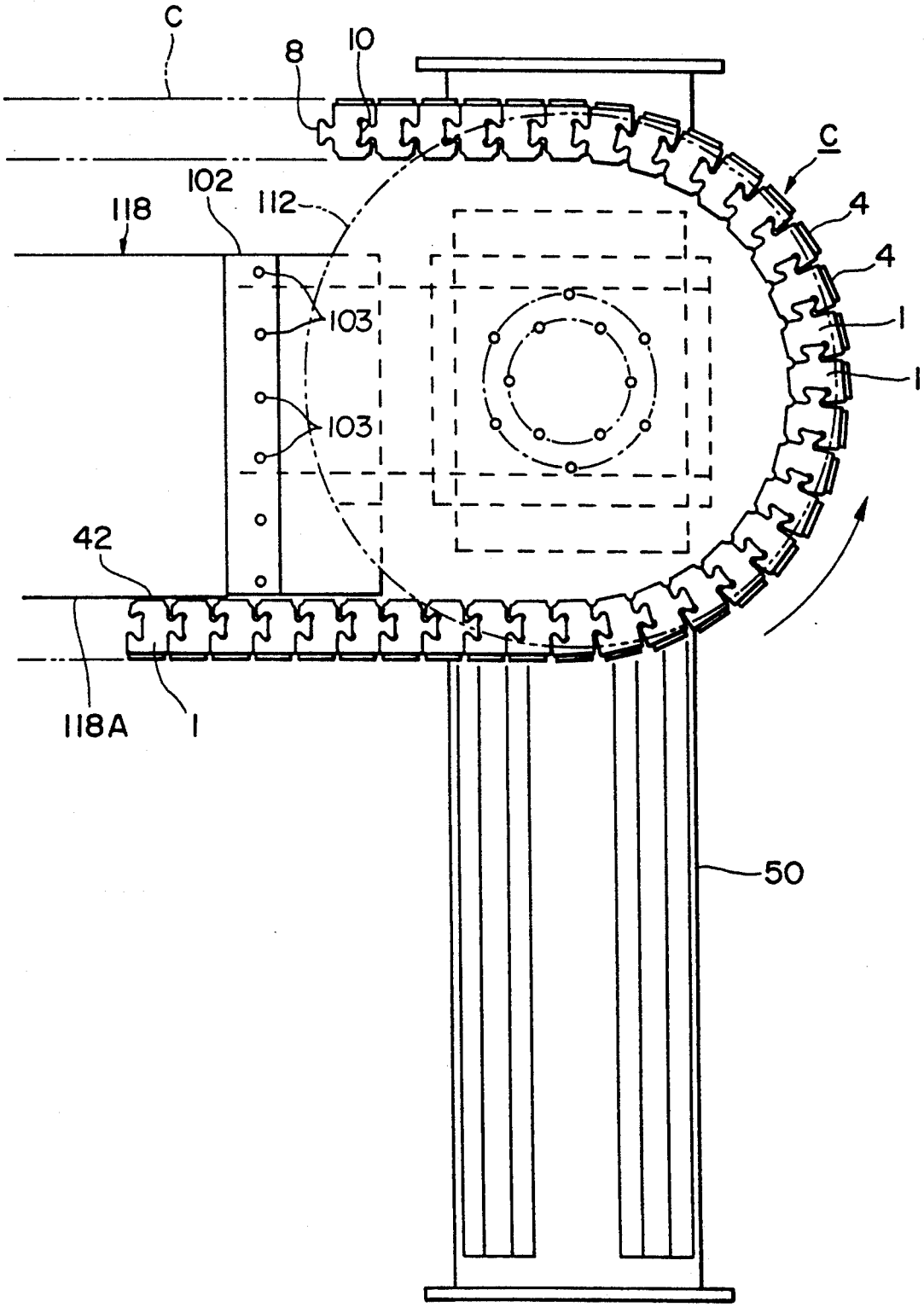
FIG. 61 is a cross-sectional view of a cutting apparatus from a fifteenth preferred embodiment.

FIG. 61 shows a fifteenth embodiment of the invention concerning the cutting apparatus. In the apparatus shown in FIG. 1, both the upper and the lower edges of the back plate 118 was in contact with the upper and the inner peripheries of the cutter C. In this embodiment, only the lower edge of the backplate is in contact with the lower peripheral region of the cutter C in the linear section.

The vertical distance between the upper and the lower edges of the backplate 118 is smaller than the winding diameter of the chain cutter, and the lower edge of the backplate is equipped with a protrusion 118A, which is inserted into the sliding groove 42. Other mechanisms remain the same as in FIG. 1.

Figure 62:
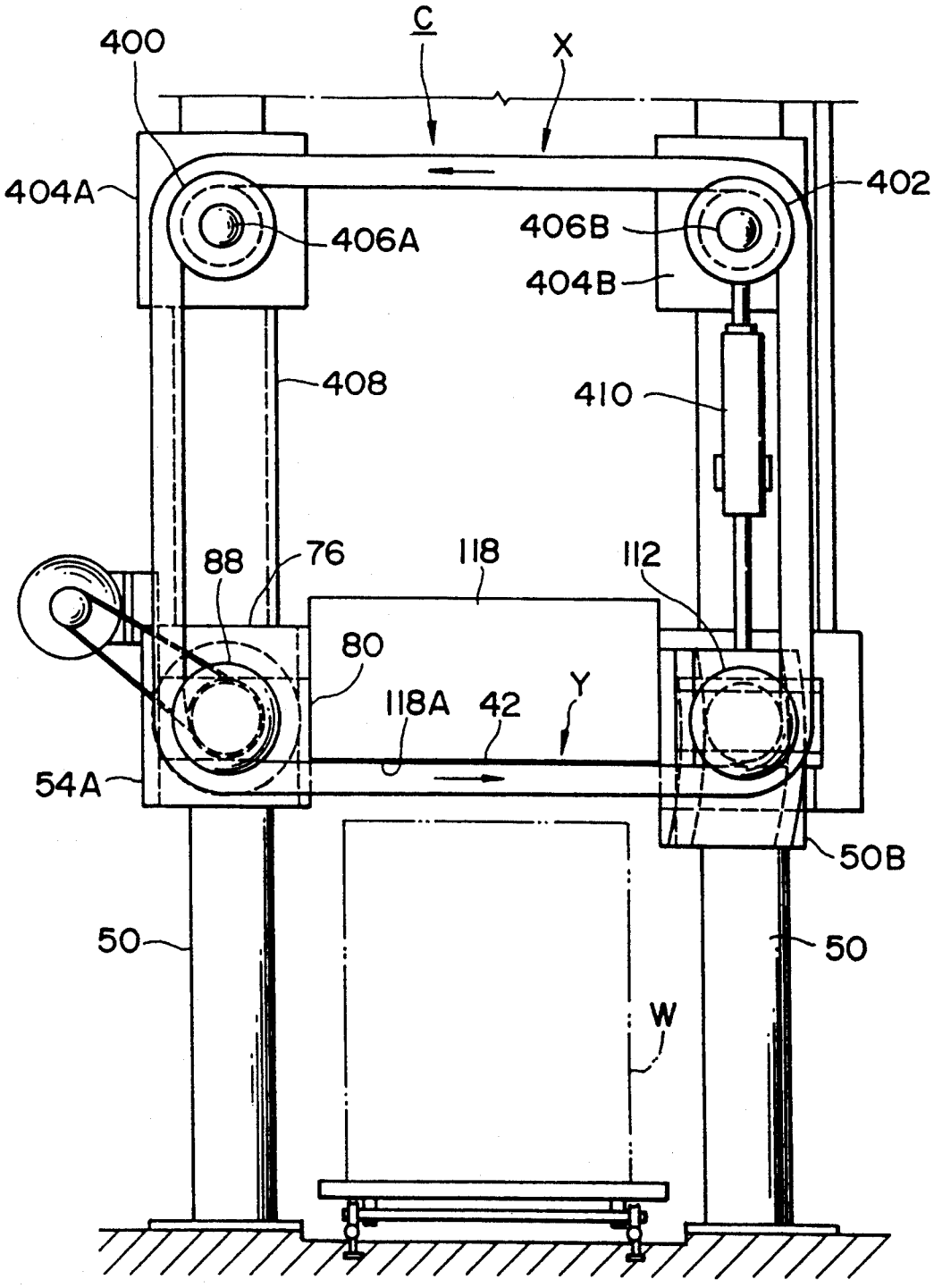
FIG. 62 is a plan view of a cutting apparatus from a sixteenth preferred embodiment.

FIG. 62 shows a sixteenth embodiment of this invention. The components which are the same as in FIG. 1 are not explained further in this section. This embodiment is characterized in that there are four sprockets in stead of two. The additional sprockets 400 and 402 are disposed in the same vertical plane as the plane joining the sprockets 88 and 112.

The left-hand shaft 50 has a movable base 404A which is separated some distance from the base 54A, and which can move freely vertically on the shaft 50. From the base 404A projects a shaft section 406A, upon which shaft is disposed a freely rotatable sprocket 400.

The right-hand shaft 50 has a movable base 404B which is separated some distance from the base 54B, and which can move freely vertically on the shaft 50. From the base 54B projects a shaft 406B, upon which shaft is disposed a freely rotatable sprocket 402.

The distance between the bases 54A and 404A is fixed and maintained by a spacer rod 408, and the pair of bases 54A and 404A moves vertically along the shaft while maintaining the constant separation.

The separation distance is adjustable with a hydraulic pressure from a hydraulic pump 410, which is located between the bases 54B and 404B.

The other components such as the backplate 118 located between the bases 54A and 54B, and the support plate 80 are the same as in FIG. 1.

According to this arrangement of the sprockets, it is possible to keep the upper straight section X of the chain C, which does not take part in the cutting operation, away from the lower straight section which is performing the cutting. This is useful in cases of cutting large objects, since the diameter of the sprockets, 88, 112, 400 and 402, need not be correspondingly large, thus making it possible to cut large objects with a compact cutting machine.

Therefore, when the size of the object to be cut changes, it is only necessary to alter the separation of the sprockets 400 and 88 in cooperation with sprockets 402 and 112. Thus, the chain cutter arrangement shown in FIG. 62 enables cutting of objects of varying sizes without changing the sprockets. This is important since changing the sprocket diameter changes the relative fit of the bit groove with the sprocket teeth, and consequently, a new sprocket requires a new flap. The versatility of this chain cutter permits a cost efficient operation.

Although in the above preferred embodiment, four sprockets were used, other arrangement such as 3 or over 5 sprockets can also be used. If it is necessary to cut with the upper straight section X of the chain, relocate the sprockets 400 and 402 below the sprockets 88 and 112, and operate the cutter by pressing from the top onto the bottom surface of the object.

Figure 63:
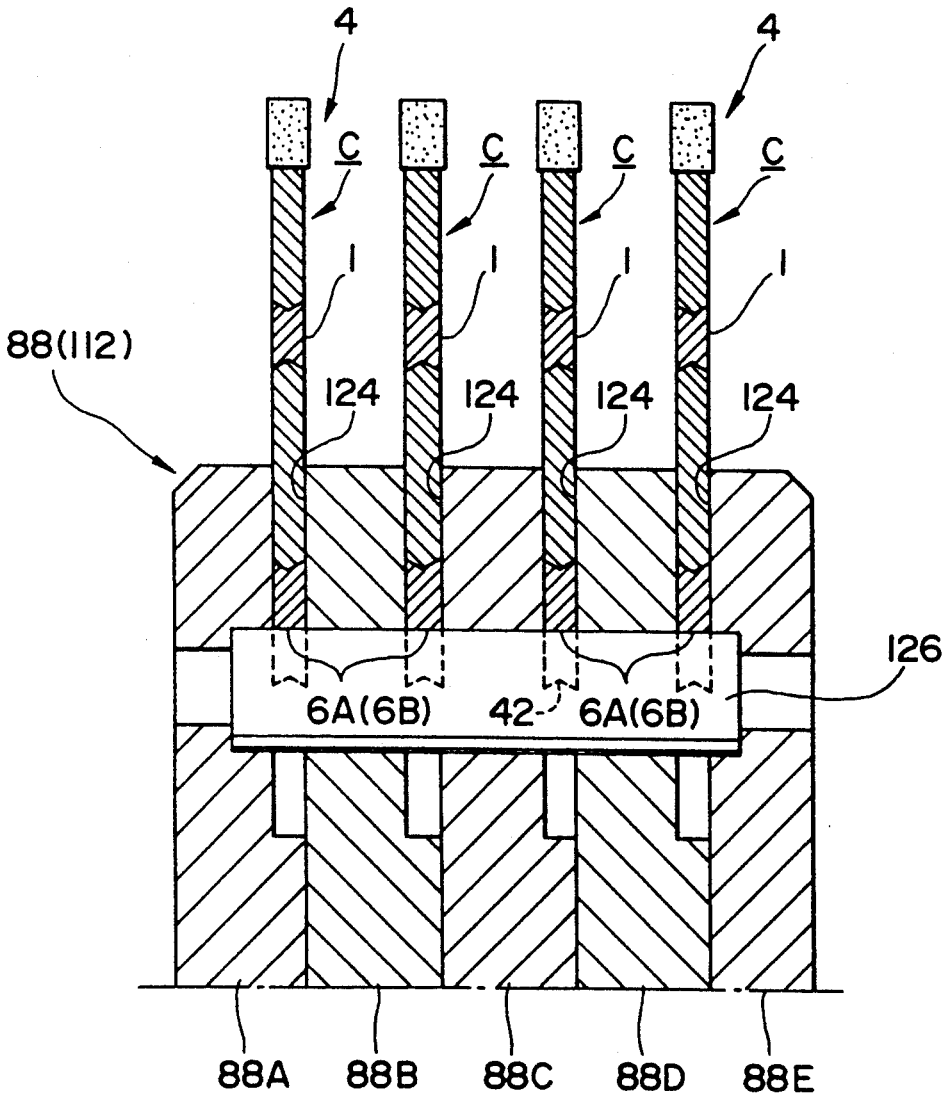
FIG. 63 is a cross-sectional view of the sprocket and the chain cutter from a seventeenth preferred embodiment.

FIG. 63 shows a seventeenth preferred embodiment, in which the cutters are arranged in plurality. In this illustrious, four cutters are arranged in a multi-sprockets configuration effected by stacking several plates 88A–88E forming a cylindrical rod extending in the axial direction. There are plurality of slits 124 on the circumference of the sprockets, and inside each slit is a corresponding chain cutter C to be driven with the pins 126 which penetrate through the plates 88B, 88C and 88D disposed at equal distances around the circumference.

According to this muti-bladed chain cutter, it is possible to produce several cut sections of rocks and objects in a similar way to a gang-saw, permitting a high efficiency operation. In contrast to the reciprocating action gang-saw, however, the chain cutter moves in one direction only, thus, the wear of the rear region of the cutting area does not occur. Excessive wear of the supporting region of the abrasive area is thus avoided, and there is little loss of cutting media from the abrasive bits. The cutting movement is more efficient since the cutting direction is unidirectional, unlike a reciprocating gang-saw.

In this preferred embodiment 17, it is possible to provide mechanisms for adjusting the tension of each chain body and mechanisms for adjusting the distance of each chain body.

Figure 64:
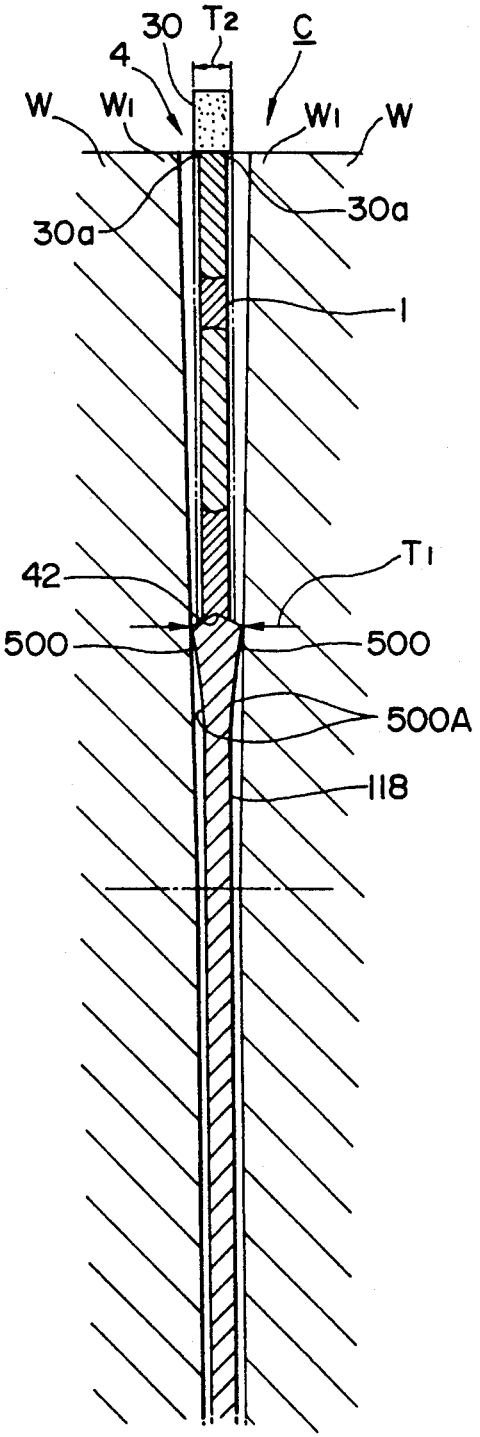
FIG. 64 is a cross-sectional view to illustrate the construction of the backplate from an eighteenth preferred embodiment.

FIG. 64 is an eighteenth preferred embodiment of this invention, characterized in that a provision, a pair of protrusions 500 protruding perpendicularly to the thickness direction, is made on the rear area of the backplate 118. The thickness T1 of the protrusion 500 is two times the thickness of the cutting device 4. The tapered protrusion extends along the back plate towards the center of the backplate 118 continuously and smoothly.

According to this preferred embodiment, when the cutting depth into the object W is deeper than the radius of the chain cutter C, the protrusion performs the function of separating the two cut surfaces so that the upper cutting edges will not interference with said surfaces. In particular, as shown by the double-dot broken line in FIG. 2, the protrusion 500 is designed to prevent the bottom edge 30*a* of the cutting device 4 will not interfere with the edge $W_1$ of the cut surface of the work piece W to cause breakage of the work piece or of the bits 30.

In reference to the above, it is not necessary to have the protrusion 500 extending continuously along the backplate 118, it can be disposed periodically along a suitable path.

Figure 65:
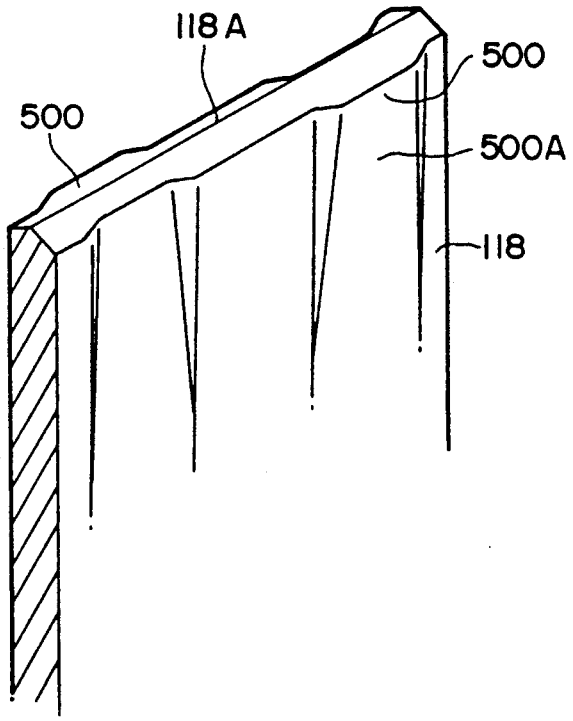
FIG. 65 is an angle view of a modified backplate shown in FIG. 64.

FIG. 65 shows a variation of the protrusion 500 on the backplate 118. The protrusions are made alternately on each side surface of the backplate 118.

Such protrusions 500 can be made easily from simple plate shape materials. In comparison with the shape of the protrusion shown in FIG. 64, this shape is able to lessen the impact shock, because the latter shape is more elastic than the former.

Some modifications of the chain cutter are presented below.

i) Instead of lowering the cutter C, raise the table 134 towards the object W by providing the table with a lifting mechanism.

ii) Instead of tilting the cutter C, tilt the table 134 to adjust the angle of cut of the object W.

iii) In addition to sprockets 88 and 112, provide a separate tension adjusting mechanism by means of a pulley attached to the inside surface of the cutter C.

iv) Use a driving mechanism to tilt the cutter C.

v) Automate all the cutter drives with the use of numerical control (NC).

vi) Place the object W horizontally, for example, so that the cutting is carried out horizontally. Other configuration of the object W is also possible but they will not be listed here.

What is claimed is:

1. A cutting apparatus for cutting a workpiece, comprising:

a) a flexible endless chain body having inner and outer edges, comprising a plurality of generally planar flaps, each of the flaps having first and second opposite ends, the first end of each flap forming a connecting protrusion having a semi-circular shape and including a first pair of peripheral surfaces having semi-circular shapes, the second end of each flap forming a connecting recess having a second pair of peripheral surfaces having shapes matching the shapes of the first pair of peripheral surfaces of the flap, wherein the connecting protrusion of each one of the flaps is fitted into the connecting recess of an adjacent flap with the first pair of peripheral surfaces of the one of the flaps abutted against the second pair of peripheral surfaces of the adjacent flap, the connecting protrusions and the connecting recesses of the flaps connecting the plurality of the flaps together for angular movement in a common plane, each of the flaps having an outside edge on the outer edge of the chain body, and each of at least selected ones of the plurality of the flaps having a cutting device located at the outside edge of the flap;

b) a plurality of sprockets supporting the chain body for movement on an endless path extending around a given area and in said common plane;

c) a rigid backplate provided within the common plane and in said given area, at least one end of the backplate engaging with the inner edge of the chain body and preventing disengagement of the chain body and the backplate in a direction perpendicular to the common plane, and the backplate supporting the chain body towards the workpiece; wherein the flaps have a given thickness, and the backplate has a thickness not greater than said given thickness;

d) a rotating means for rotating at least one of the sprockets and driving the chain body around the endless path; and e) a moving means for moving the workpiece or the chain body toward each other to cut the workpiece with the chain body.

2. The cutting apparatus according to claim 1, wherein an outer periphery of each sprocket contains a support means for maintaining said chain body in said common plane.

3. The cutting apparatus according to claim 2, wherein a plurality of pairs of said support means are provided perpendicularly along the axis of the sprockets at preselected distances.

4. The cutting apparatus according to claim 1, wherein:

the cutting devices include abrasive bits having a given thickness; and surfaces of a rear region of the backplate are equipped with at least a pair of protrusions spaced apart a distance greater than the given thickness of the abrasive bits.

5. The cutting apparatus according to claim 1, wherein the backplate is provided with an elongated means to adjust a longitudinal tension of said backplate.

6. The cutting apparatus according to claim 1, further comprising a tilting means to independently tilt said chain body relative to the workpiece, to vary a relative angle between the workpiece and the chain body within the common plane.

7. The cutting apparatus according to claim 1, wherein each of the flaps is formed by bonding together three plate elements.

8. The cutting apparatus according to claim 1, wherein each of said cutting device is an abrasive cutting bit.

9. The cutting apparatus according to claim 1, wherein each of said cutting device is a saw tooth.

10. The chain cutter according to claim 1, wherein each of said cutting devices is securely and detachably mounted to a respective one corresponding flap.

11. The cutting apparatus according to claim 1, wherein the relative position of the backplate with respect to the chain body is adjustable through a positioning device.

12. The cutting apparatus according to claim 1, wherein:

each flap has an inside edge on the inner edge of the chain body;

each flap has a pair of driving recesses at first and second opposite ends of the inside edge of the flap, the driving recesses of each pair of adjacent flaps forming engage means, the engage means of the chain body being arranged at equal intervals when the chain body is bent in an arc; and said at least one of the sprockets has a plurality of driving protrusions provided at equal intervals in a circumferential direction on a periphery of said one of the sprockets, and each driving protrusion engages with corresponding engage means of the chain body to drive the chain body around said endless path.

13. The cutting apparatus according to claim 1, wherein the chain body further includes releasable connecting means, mounted on and connecting selected ones of the flaps to adjacent flaps.

14. The cutting apparatus according to claim 1, wherein:

the first end of each flap has a first engaging means, and the second end of each flap has a second engaging means; and in linearly elongated portions of the chain body, the first engaging means of each flap engages with the second engaging means of a flap adjacent to said each flap to prevent disengagement of the flaps in said elongated portions of the chain body in the direction perpendicular to the common plane.

15. A cutting apparatus according to claim 1, wherein:

the connecting protrusion of each flap has a pair of first engaging portions on the first pair of peripheral surfaces thereof, the first engaging portions being elongated in a circumferential direction of the first pair of peripheral surfaces;

the connecting recess of each flap has a pair of second engaging portions on the second pair of peripheral surfaces thereof, the second engaging portions being elongated in a circumferential direction of the second pair of peripheral surfaces on the connecting recess; and a first of the engaging portions of the connecting protrusion of each flap fits with a corresponding second engaging portion of the connecting recess of an adjacent flap to prevent disengagement of the flaps from each other in a direction perpendicular to the common plane.

16. A cutting apparatus according to claim 15, wherein:

the first engaging portion of the connecting protrusion of each flap disengages from the corresponding second engaging portion of the adjacent flap when a connecting length of said each flap and said adjacent flap is shortened, and said each flap and said adjacent flap become detachable from each other in a direction perpendicular to the common plane.

17. A cutting apparatus according to claim 1, wherein:

the first and second pair of peripheral surfaces of the connecting protrusions and the connecting recesses are perpendicular to the common plane;

the first end of the each flap has a first engaging means, and the second end of each flap has a second engaging means; and the first engaging means of each flap engages the second engaging means of an adjacent flap connected to said each flap, in linearly elongated portions of the chain body, to prevent disengagement of the flaps of the elongated portions from each other in a direction perpendicular to the common plane.

18. A cutting apparatus for cutting a workpiece, comprising:

a) a flexible endless chain body having inner and outer edges, and comprising a plurality of generally planar flaps, each of the flaps having first and second opposite ends, the first end of each flap forming a first connecting portion, the second end of each flap forming a second connecting portion, the first connecting portion of each flap being connected with the second connecting portion of an adjacent flap to connect said each flap thereto, the first and second connecting portions of the flaps connecting the plurality of flaps together for angular movement in a common plane, each of the flaps having an outside edge on the outer edge of the chain body, each of at least selected ones of the plurality of the flaps having a cutting device located at the outside edge of the flap, and each flap having an inner area forming a driving throughhole;

b) a plurality of supporting sprockets supporting the chain body for movement on an endless path extending around a given area and in said common plane;

c) at least one driving sprocket provided alongside the chain body, comprising a plurality of driving protrusions provided at equal intervals in a circumferential direction on a periphery of the driving sprocket, the driving protrusions engaging the driving throughholes of the flaps of the chain body to drive the chain body around said endless path;

wherein as the flexible chain moves around said endless path, the chain includes first and second sections, each of said sections including a plurality of the flaps, and wherein the driving throughholes of the flaps in said first and second sections are spaced apart at regular intervals;

d) a rigid backplate provided within the common plane and in said given area, at least one end of the backplate engaging with the inner edge of the chain body and preventing disengagement of the chain body and the backplate in a direction perpendicular to the common plane, and the backplate supporting the chain body towards the workpiece; wherein the flaps have a given thickness, and the backplate has a thickness not greater than said given thickness;

e) a rotating means for rotating the driving sprocket; and f) a moving means for moving the workpiece or the chain body toward each other to cut the workpiece with the chain body;

wherein said driving sprocket includes an outer peripheral surface facing toward the inner edge of the chain body, and defines an axis extending parallel to said common plane.

19. A cutting apparatus for cutting a workpiece, comprising:

a) a flexible endless chain body having inner and outer edges, and comprising a plurality of generally planar flaps, each of the flaps having first and second opposite ends, the first end of each flap forming a first connecting portion, the second end of each flap forming a second connecting portion, the first connecting portion of each flap being connected with the second connecting portion of an adjacent flap to connect said each flap thereto, the first and second connecting portions of the flaps connecting the plurality of flaps together for angular movement in a common plane, each of the flaps having an outside edge on the outer edge of the chain body, each of at least selected ones of the plurality of the flaps having a cutting device located at the outside edge of the flap, each of the cutting devices including a mounting projection, the outside edge of each of the selected ones of the flaps forming a mounting recess receiving the mounting projection of the cutting device connected to said each of the selected ones of the flaps, each of the mounting recesses including an elastically movable section to selectively engage and release the mounting projection received in said each mounting recess;

b) a plurality of sprockets supporting the chain body for movement on an endless path extending around a given area and in said common plane;

c) a rigid backplate provided within the common plane and in said given area, at least one end of the backplate engaging with the inner edge of the chain body and preventing disengagement of the chain body and the backplate in a direction perpendicular to the common plane, and the backplate supporting the chain body toward the workpiece; wherein the flaps have a given thickness, and the backplate has a thickness not greater than said given thickness;

d) a rotating means for rotating at least one of the sprockets and driving the chain body around the endless path; and e) a moving means for moving the workpiece or the chain body toward each other to cut the workpiece with the chain body.

20. A cutting apparatus for cutting a workpiece, comprising:

a) a flexible endless chain body having inner and outer edges, and comprising a plurality of generally planar flaps arranged in a common plane, each of the flaps having first and second opposite ends and an outside edge on the outer edge of the chain body, the first end of each flap forming a connecting protrusion having a disk shape having a center axis and a peripheral surface perpendicular to the common plane, the second end of each flap forming a connecting recess having an inner peripheral surface having a shape complementary with the shape of the connecting protrusion of the flap, and the connecting protrusion of each one of the flaps being fitted into the connecting recess of an adjacent flap, the connecting protrusions and the connecting recesses connecting the plurality of flaps together for angular movement in said common plane;

b) a plurality of cutting devices located at the outside edges of at least selected ones of the plurality of the flaps;

c) a plurality of sprockets supporting the chain body for movement on an endless path extending around a given area in said common plane;

d) a rigid backplate provided within the common plane and in said given area, at least one end of the backplate engaging with the inner edge of the chain body and preventing disengagement of the chain body and the backplate in a direction perpendicular to the common plane, and the backplate supporting the chain body towards the workpiece; wherein the flaps have a given thickness, and the backplate has a thickness not greater than said given thickness;

e) a rotating means for rotating the sprockets and driving the chain body around the endless path; and f) a moving means for moving the workpiece or the chain body toward each other to cut the workpiece with the chain body;

wherein as the flexible chain body moves around said endless path, the chain body includes linearly elongated portions, each of said linearly elongated portions including a plurality of the flaps, and the outside edges of the flaps in each of the linearly elongated portions defining a straight line;

wherein the first end of each flap has a first engaging means between the outside edge of the flap and the connecting protrusion thereof, and the second end of each flap has a second engaging means between the outside edge of the flap and the connecting recess thereof; and the first engaging means of each flap in said linearly elongated portions of the chain body engages the second engaging means of an adjacent flap to prevent disengagement of the flaps in said linearly elongated portions from each other in a direction perpendicular to the common plane and to prevent pivotal movement of said each flap and said adjacent flap around the center axis of the connecting protrusion of said adjacent flap in an outward direction beyond the straight line defined by the outside edges of the flaps; and wherein the first engaging means of each flap disengages from the second engaging means of an adjacent flap when a portion of the chain body including said each and said adjacent flaps is bent inwardly to a predetermined radius of curvature and said each and said adjacent flaps become detachable from each other in the direction perpendicular to the common plane.

21. A cutting apparatus for cutting a workpiece, comprising:

a) a flexible endless chain body having inner and outer edges, and comprising a plurality of generally planar flaps, each of the flaps consisting of a center plate having first and second sides and first and second side plates bonded, respectively, to the first and second sides of the center plate, each of the flaps having first and second opposite ends, the first end of each flap forming a connecting protrusion having at least a first engaging portion formed by a peripheral surface of the center plate of the flap, the second end of each flap forming a connecting recess having a shape complementary with the shape of the connecting protrusion of the flap, the connecting recess of each flap including at least a second engaging portion formed by an inner peripheral surface of the center plate of the flap, and the connecting protrusion of each one of the flaps fitting into the connecting recess of an adjacent flap with the first engaging portion of said each flap engaged with the second engaging portion of said adjacent flap, the connecting protrusions and the connecting recesses of the flaps connecting the plurality of flaps together for angular movement in a common plane while preventing disengagement of the flaps from each other in a direction perpendicular to the common plane, and each flap having an outer edge on the outer edge of the chain body;

b) a plurality of cutting devices located at the outer edges of at least selected ones of the plurality of flaps;

c) a plurality of sprockets supporting the chain body for movement on an endless path extending around a given area in said common plane;

d) a rigid backplate provided within the common plane and in said given area, at least one end of the backplate engaging with the inner edge of the chain body and preventing disengagement of the chain body and the backplate in a direction perpendicular to the common plane, and the backplate supporting the chain body towards the workpiece; wherein the flaps have a given thickness, and the backplate has a thickness not greater than said given thickness;

e) a rotating means for rotating the sprockets and driving the chain body around the endless path; and f) a moving means for moving the workpiece or the chain body toward each other to cut the workpiece with the chain body.

* * * * *

UNITED STATES PATENT AND TRADEMARK OFFICE

CERTIFICATE OF CORRECTION

PATENT NO. : 5,226,404

DATED : July 13, 1993

INVENTOR(S) : Katsumi Mogi, et al.

It is certified that error appears in the above-indentified patent and that said Letters Patent is hereby corrected as shown below:

Column 4, line 23: after "embodiment" insert --.--

Column 8, line 8: "on" should read --one--

Column 13, line 61: "a" should read --as--

Column 16, line 36: "no" should read --not--

Column 20, line 30: "arc" should read --arcs--

Column 26, line 14, Claim 17: "of the each" should read --of each--

Signed and Sealed this

Twenty-fifth Day of October, 1994

*Attest:*

*Attesting Officer*

Bruce Lehman

BRUCE LEHMAN

*Commissioner of Patents and Trademarks*